US010018953B2

(12) United States Patent
Tajiri

(10) Patent No.: US 10,018,953 B2
(45) Date of Patent: Jul. 10, 2018

(54) IMAGE PROCESSING APPARATUS

(71) Applicant: BROTHER KOGYO KABUSHIKI KAISHA, Nagoya-shi, Aichi-ken (JP)

(72) Inventor: Fumitake Tajiri, Nagoya (JP)

(73) Assignee: BROTHER KOGYO KABUSHIKI KAISHA, Nagoyga, Aichi (JP)

( * ) Notice: Subject to any disclaimer, the term of this patent is extended or adjusted under 35 U.S.C. 154(b) by 0 days.

(21) Appl. No.: 15/333,292

(22) Filed: Oct. 25, 2016

(65) Prior Publication Data

US 2017/0123366 A1 May 4, 2017

(30) Foreign Application Priority Data

Oct. 28, 2015 (JP) ..... 2015-211618

(51) Int. Cl.

| | |
|---|---|
| ***B65H 29/58*** | (2006.01) |
| ***B65H 29/60*** | (2006.01) |
| ***B65H 85/00*** | (2006.01) |
| ***G03G 15/00*** | (2006.01) |
| ***G03G 21/14*** | (2006.01) |

(Continued)

(52) U.S. Cl.

CPC ..... *G03G 15/6579* (2013.01); *B65H 15/00* (2013.01); *B65H 85/00* (2013.01); *G03G 15/234* (2013.01); *G03G 15/6502* (2013.01); *G03G 15/6552* (2013.01); *G03G 21/14* (2013.01); *B65H 2301/33312* (2013.01); *B65H 2511/11* (2013.01); *B65H 2701/1313* (2013.01); *G03G 2215/00421* (2013.01); *G03G 2215/00438* (2013.01)

(58) Field of Classification Search

CPC ..... G03G 15/234; G03G 15/6579; G03G 2215/0043; G03G 2215/00438; G03G 2215/00586; G03G 2215/00721; G03G 2215/00734; B65H 85/00; B65H 2301/33312; B65H 2513/50; B65H 2513/51; B65H 2513/511; B65H 2513/514; B65H 2511/11

See application file for complete search history.

(56) References Cited

U.S. PATENT DOCUMENTS 4,568,169 A * 2/1986 Wada ..... G03G 15/234 271/186
4,853,740 A * 8/1989 Ushio ..... G03G 15/234 355/24

(Continued)

FOREIGN PATENT DOCUMENTS

JP 2000-321827 A 11/2000
JP 2002-365862 A 12/2002

(Continued)

*Primary Examiner* — Luis A Gonzalez

(74) *Attorney, Agent, or Firm* — Scully, Scott, Murphy & Presser, P.C.

(57) ABSTRACT

A controller calculates a first time period T1 and a second time period T2. The first time period T1 is defined as a time period required for conveying the end portion of the sheet, which is conveyed in a first conveyance direction E, disposed on the upstream side in the first conveyance direction E up to a reversal position A3. The second time period T2 is defined as a time period required for conveying an end portion of the reversed sheet disposed on an upstream side in a second conveyance direction R from the reversal position A3 to a branching point A1.

20 Claims, 15 Drawing Sheets

(51) Int. Cl.
*B65H 15/00* (2006.01)
*G03G 15/23* (2006.01)

(56) References Cited

U.S. PATENT DOCUMENTS 4,928,128 A * 5/1990 Stemmle ..... G03G 15/234 271/186
5,132,719 A * 7/1992 Kioka ..... G03G 15/234 355/24
5,893,020 A * 4/1999 Atsumi ..... G03G 15/231 399/364
6,345,170 B1 2/2002 Nakazato et al.
7,130,574 B2 * 10/2006 Carter ..... G03G 15/234 101/230
8,757,618 B2 * 6/2014 Matsumoto ..... B65H 7/02 271/264
8,849,146 B2 * 9/2014 Campbell ..... G03G 15/234 399/402
8,891,093 B2 * 11/2014 Saida ..... G03G 15/231 358/1.1
2006/0269339 A1 11/2006 Okamoto et al.
2006/0290049 A1 12/2006 Fujiwara
2011/0085838 A1 * 4/2011 Won ..... B65H 85/00 399/397
2011/0279876 A1 11/2011 Okano

FOREIGN PATENT DOCUMENTS

JP 2006-330250 A 12/2006
JP 2006-330420 A 12/2006
JP 2007-039203 A 2/2007
JP 2007-051004 A 3/2007
JP 2007-119256 A 5/2007
JP 2011-102172 A 5/2011
JP 2011-236030 A 11/2011

* cited by examiner

IMAGE PROCESSING APPARATUS

CROSS-REFERENCE TO RELATED APPLICATION

This application claims priorities from Japanese Patent Application No. 2015-211618 filed on Oct. 28, 2015, the entire subject matters of which is incorporated herein by reference.

TECHNICAL FIELD

The present invention relates to an image forming apparatus that reverses a sheet having an image formed on one face thereof and, after circulating the sheet on a conveyance path, forms an image on the other face of the sheet again.

BACKGROUND

In the related art, among image forming apparatuses, there are apparatuses each performing double-sided printing by reversing a sheet after printing an image on one face of the sheet using an image forming unit and printing an image on the other face of the sheet by conveying the sheet to the image forming unit again (for example, see JP-A-2007-039203). An image forming apparatus disclosed in JP-A-2007-39203, for example, after printing an image on one face of a first sheet, supplies a second sheet from a supply device to a conveyance path and performs consecutive double-sided printing alternately for each of the two sheets. In this case, the image forming apparatus should appropriately control a sheet space between two sheets in order to suppress a collision between the first sheet and the second sheet. More specifically, the image forming apparatus should adjust a sheet space by controlling the conveyance speed of sheets at each point in the conveyance path and the like.

The image forming apparatus described above conveys a sheet having an image printed on one face to the image forming unit again through a circulation path. The circulation path branches from the middle of a sheet discharging path which is configured to connect a discharge port discharging the sheet and the image forming unit to each other, and the circulation path is connected to the upstream side of the image forming unit. In addition, a reversal path reversing a sheet branches from the middle of this circulation path. The image forming apparatus conveys a sheet having an image printed on one face from the circulation path to the reversal path, reverses the sheet, and conveys the sheet again up to the image forming unit through the circulation path.

In the conveyance path described above, the sheet discharging path and the reversal path are arranged as independent paths different from each other. In a case where the sheet discharging path and the reversal path are separately arranged, there may be a concern that the whole length of the conveyance path becomes long. For this reason, a space used for arranging the conveyance path should be large enough inside the apparatus. In addition, there may be a concern that, in accordance with an increase in the conveyance path, the numbers and the like of rollers and drive sources used for conveying a sheet may increase. Consequently, there may be a concern that the size of the image forming apparatus may become large.

SUMMARY

The present disclosure has been made in view of the above circumstances, and one of objects of the present disclosure is to provide an image forming apparatus that shortens the length of a conveyance path by overlapping a sheet discharging path and a reversal path with each other in an image forming apparatus forming images on both faces of a sheet and is capable of appropriately controlling a sheet space between a plurality of sheets conveyed to the conveyance path.

According to an illustrative embodiment of the present disclosure, there is provided an image forming apparatus including: a conveyance path; a supply device that supplies a sheet to the conveyance path; an image forming unit that forms an image on the sheet conveyed through the conveyance path; a discharge port; a discharge and reverse roller that discharges or reverses the sheet, on which the image is formed by the image forming unit, from the discharge port; a circulation roller that conveys the sheet reversed by the discharge and reverse roller; and a controller. A conveyance direction of the sheet conveyed from the image forming unit toward the discharge port is defined as a first conveyance direction. A direction in which the sheet reversed by the discharge and reverse roller is conveyed toward the circulation roller is defined as a second conveyance direction. The conveyance path includes: a branching point that is disposed on a further downstream side in the first conveyance direction than a position of the image forming unit; a merging point that is disposed on a further upstream side in the first conveyance direction than the position of the image forming unit; a discharge path that connects the supply device to the branching point through the image forming unit; a discharge and reversal path that connects the branching point to the discharge port through the discharge and reverse roller; and a circulation path that connects the branching point to the merging point not through the image forming unit but through the circulation roller. The controller is configured to control other components to perform: a consecutive image forming process in which, in a case where an image is formed by the image forming unit on each face of two sheets including a first sheet and a second sheet, an image is formed on one face of the second sheet during a period after an image is formed on one face of the first sheet and until an image is formed on the other face by a reversal of the first sheet; and a sheet interval adjustment process in which in a case where, a reversal position is defined at a position at which an end portion of the sheet disposed on an upstream side in the first conveyance direction reaches when a sheet conveyed through the discharge and reversal path in the first conveyance direction is reversed by the discharge and reverse roller, a first time period is defined as a time period required for conveying the end portion of the sheet, which is conveyed in the first conveyance direction, disposed on the upstream side in the first conveyance direction up to the reversal position after an end portion of the sheet disposed on the downstream side in the first conveyance direction passes through the branching point, and a second time period is defined as a time period required for conveying an end portion of the reversed sheet disposed on an upstream side in the second conveyance direction from the reversal position to the branching point, a time difference between the first sheet having the image formed and reversed in the consecutive image forming process and the second sheet on which an image is formed after the first sheet is set to a time longer than a time acquired by adding the first time period and the second time period.

DETAILED DESCRIPTION

Figure 1:
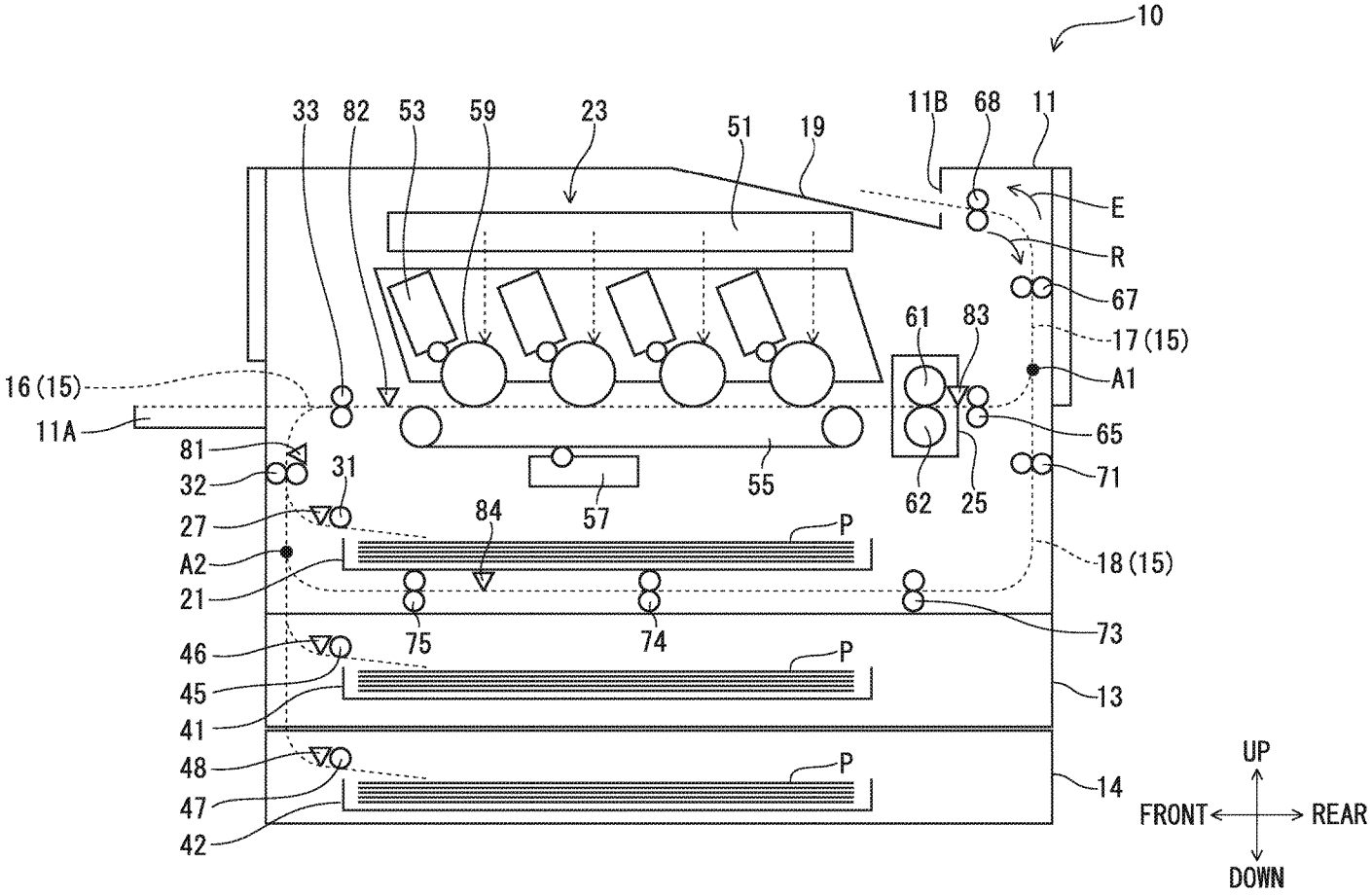
FIG. 1 is a schematic diagram that schematically illustrates the configuration of a printer according to an embodiment.

Hereinafter, an embodiment, in which an image forming apparatus according to the present disclosure is embodied as a printer 10, will be described in detail with reference to the drawings. In the following description, as illustrated in FIG. 1, a left side toward the sheet face will be referred to as a "front", a right side toward the sheet face will be referred to as a "rear", and a vertical direction toward the sheet face will be referred to as an "upward-downward direction".

The printer 10 according to this embodiment, for example, is a color laser printer of a direct transfer tandem system. As illustrated in FIG. 1, the printer 10 includes a printer main body 11 having a substantially box shape and two optional devices 13 and 14. The printer main body 11 includes a main body sheet feeding tray 21, an image forming unit 23, a fixing unit 25, and the like. The main body sheet feeding tray 21 is disposed at the bottom of the printer main body 11. In the main body sheet feeding tray 21, a plurality of sheets P (paper sheets. OHP sheets, or the like) are accommodated. The main body sheet feeding tray 21 is attachable/detachable to/from a casing of the printer main body 11. In addition, in the printer main body 11, a tray sensor 27 is disposed which detects the presence/absence of attachment of the main body sheet feeding tray 21.

Each of sheets P disposed inside the main body sheet feeding tray 21 is separated by a sheet feeding roller 31 and is conveyed to a conveyance path 15. The sheet P conveyed to the conveyance path 15 is conveyed up to the image forming unit 23 by a conveyance roller 32 and a registration roller (hereinafter, referred to as a "registration roller") 33. The registration roller 33 arranges the posture of the sheet P that has been conveyed and sends the sheet P to a belt unit 55 of the image forming unit 23 at predetermined timing.

The optional device 13 is disposed under the printer main body 11 and accommodates sheets P in a sheet feeding tray 41. The optional device 14 is disposed under the optional device 13 and accommodates sheets P in a sheet feeding tray 42. The sheets P accommodated in the optional devices 13 and 14, for example, are sheets of sizes different from the size of the sheets P disposed in the main body sheet feeding tray 21.

The optional device 13 conveys a sheet P to the conveyance path 15 by driving the sheet feeding roller 45 in response to a request from the printer main body 11. In the optional device 13, a tray sensor 46 that detects the presence/absence of attachment of the sheet feeding tray 41 that can be attached or detached is disposed. Similarly, the optional device 14 conveys a sheet P3 to the conveyance path 15 by driving the sheet feeding roller 47 in response to a request from the printer main body 11. In the optional device 14, a tray sensor 48 that detects the presence/absence of attachment of the sheet feeding tray 42 that can be attached or detached is disposed.

In a cover portion disposed on the front of the printer main body 11, an input tray 11A used for placing a sheet P is disposed. The input tray 11A is disposed to be rotatable toward the front with respect to the printer main body 11.

The image forming unit 23 is disposed above the main body sheet feeding tray 21 and forms an image on one face (the front face or the rear face) of the sheet P. The image forming unit 23 includes: a scanner unit 51; four image forming units 53; a belt unit 55; and a toner collecting unit 57. The scanner unit 51 is disposed above the printer main body 11 and includes a polygon motor, a polygon mirror, a laser light source, a reflection mirror, a lens, and the like. The scanner unit 51 emits laser light that is based on desired image data from the laser light source and generates an electrostatic latent image on the surface of a photosensitive drum 59 of each image forming unit 53 through the polygon mirror, the reflection mirror, the lens, and the like.

The four image forming units 53 are disposed between the scanner unit 51 and the belt unit 55 in the vertical direction and are arranged parallel along the horizontal direction. The image forming units 53, for example, correspond to toner colors of yellow, magenta, cyan and black in order from the front. Each image forming unit 53 uniformly charges the surface of the photosensitive drum 59 with positive polarity using an electric charger (not illustrated in the drawing). The image forming unit 53 supplies toner to an electrostatic latent image generated on the surface of the photosensitive drum 59, thereby generating a toner image by developing the electrostatic latent image.

The belt unit 55 is disposed below the four image forming units 53 and is disposed above the main body sheet feeding tray 21. The belt unit 55 rotates a circular belt, thereby conveying a sheet P to the fixing unit 25. In addition, the belt unit 55 applies a transfer bias having negative polarity to a transfer roller (not illustrated in the drawing) disposed on the inner side of the belt, thereby transferring a toner image formed on the surface of the photosensitive drum 59 onto the sheet P. In a case where each photosensitive drum 59 is rotated in a state in which a transfer bias is not applied to the transfer roller, a toner image carried on the photosensitive drum 59 is collected by the toner collecting unit 57.

The fixing unit 25 is disposed on the rear of the belt unit 55 and thermally fixes a toner image transferred on a sheet P. The fixing unit 25 includes a heating roller 61 and a pressing roller 62. The heating roller 61 includes a heat source such as a halogen lamp and is disposed to be driven to rotate. The pressing roller 62 is arranged under the heating roller 61 and is brought into contact with the heating roller 61 so as to press the heating roller 61. While heating the sheet P carrying a toner image, the fixing unit 25 sandwiches the sheet P between the heating roller 61 and the pressing roller 62. In this way, the fixing unit 25 thermally fixes the toner image formed on the sheet P.

In an upper portion of the printer main body 11, a sheet discharging tray 19 is disposed. In the printer main body 11, a discharge port 11B is formed in a rear end portion of the sheet discharging tray 19. The conveyance path 15, as illustrated in FIG. 1, has a path having a substantially "S" shape from a sheet feed position of the main body sheet feeding tray 21 to the discharge port 11B through the image forming unit 23. The conveyance path 15 branches into three paths at a branching point A1 disposed on the downstream side of the heating roller 61. The conveyance path 15 is disposed to extend from the branching point A1 to the discharge port 11B toward the upper side. In addition, the conveyance path 15 is disposed to extend from the branching point A1 toward the lower side and merges with a front-side path at a merging point A2 through the lower side of the main body sheet feeding tray 21.

In the description presented below, a path from a sheet feed position of each of the main body sheet feeding tray 21, the sheet feeding tray 41, and the sheet feeding tray 42 to the branching point A1 will be referred to as a discharge path 16. In addition, a path from the branching point A1 to the discharge port 11B will be referred to as a discharge and reversal path 17 in the description. Furthermore, a path from the branching point A1 to the merging point A2 will be referred to as a circulation path 18 in the description.

On the rear of the heating roller 61, a conveyance roller 65 is disposed. The conveyance roller 65 conveys a thermally-fixed sheet P to the discharge and reversal path 17 through the branching point A1. In the discharge and reversal path 17, a first discharge and reverse roller 67 that is arranged above the branching point A1 and a second discharge and reverse roller 68 that is arranged on the downstream side of the first discharge and reverse roller 67 near the discharge port 11B are disposed.

Each of the first and second discharge and reverse rollers 67 and 68 is configured by one pair of rollers that are forwardly and reversely rotatable and conveys a sheet P that is conveyed through the discharge and reversal path 17 with the sheet sandwiched therebetween. The first and second discharge and reverse rollers 67 and 68 convey a sheet P on which an image is printed toward the discharge port 11B (in a first conveyance direction E illustrated in FIG. 1). Hereinafter, the rotation directions of the first and second discharge and reverse rollers 67 and 68 in the first conveyance direction E will be referred to as forward directions. At the time of double-sided printing to be described later, the sheet P is conveyed toward the circulation path 18 (toward a second conveyance direction R illustrated in the drawing). Hereinafter, the rotation directions of the first and second discharge and reverse rollers 67 and 68 in the second conveyance direction R will be referred to as reverse rotation directions.

In the circulation path 18, a first circulation roller 71 (an example of the circulation roller) and second circulation rollers 73, 74, and 75 (an example of the circulation roller) are disposed. The first circulation roller 71 is disposed below the branching point A1 and conveys a sheet P that is reversed by the first discharge and reverse roller 67 and the like to the downstream side (the merging point A2 side) of the second conveyance direction R in the circulation path 18. The second circulation rollers 73, 74, and 75 are disposed in this order from the rear toward the front (from the upstream of the circulation path 18 toward the downstream) below the printer main body 11. The second circulation rollers 73, 74, and 75 are arranged with a predetermined gap arranged therebetween in the horizontal direction. The second circulation rollers 73, 74, and 75 convey a sheet P conveyed from the first circulation roller 71 up to the merging point A2. The sheet P is conveyed to the image forming unit 23 through the circulation path 18 and the discharge path 16.

In the conveyance path 15, sheet sensors 81, 82, 83, and 84 detecting the presence/absence of a sheet P are disposed. Each of the sheet sensors 81 to 84, for example, is an optical sensor, sets a detection region on the conveyance path 15, and outputs a detection signal corresponding to the presence/absence of a sheet P inside the detection region. The sheet sensor 81 is disposed above the conveyance roller 32. The sheet sensor 82 is disposed between the registration roller 33 and the belt unit 55. The sheet sensor 83 is disposed between the fixing unit 25 and the conveyance roller 65. The sheet sensor 84 is disposed between the second circulation roller 74 disposed at the center in the horizontal direction and the second circulation roller 75 disposed on the front among the three second circulation rollers 73, 74, and 75.

Figure 2:
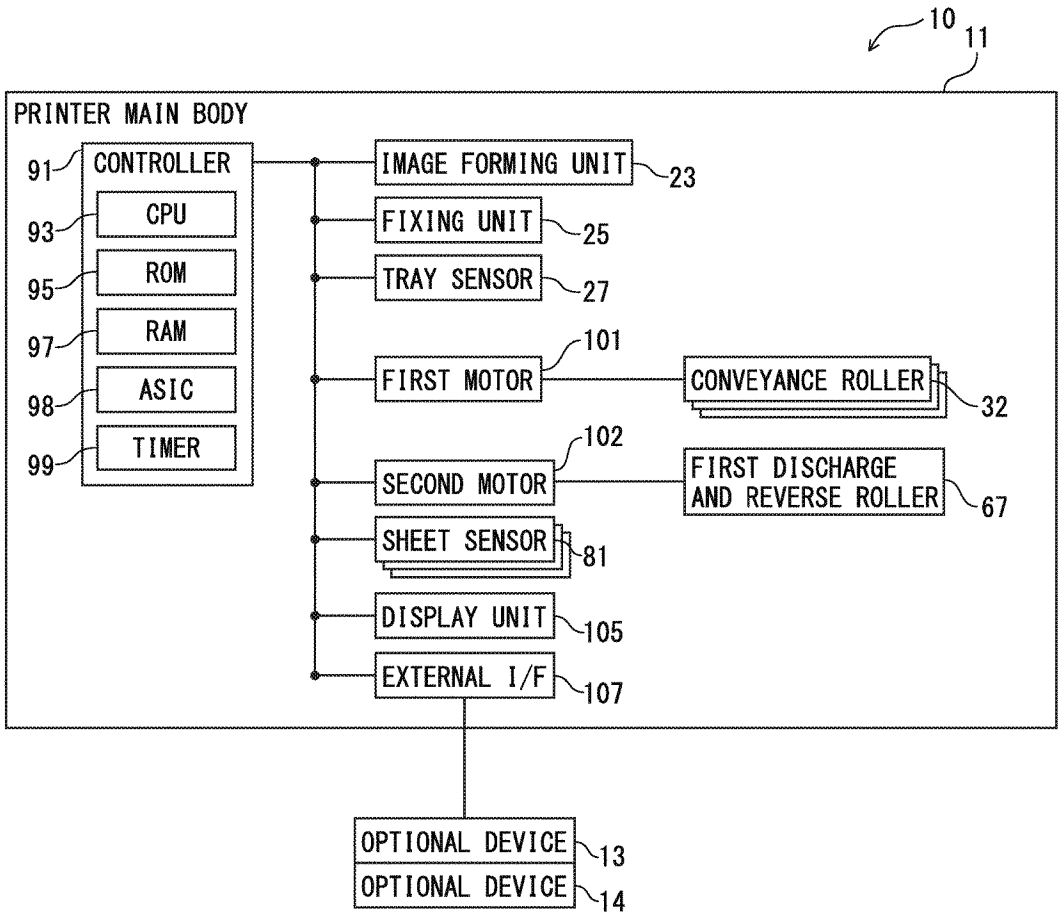
FIG. 2 is a block diagram that illustrates an electrical configuration of a printer main body.

FIG. 2 is a diagram that illustrates the electrical configuration of the printer main body 11. A controller 91 of the printer main body 11 includes a CPU 93, a ROM 95, a RAM 97, an ASIC 98, a timer 99, and the like. The controller 91 executes various programs stored in the ROM 95 using the CPU 93, thereby controlling each unit of the printer 10. Alternatively, the controller 91 performs a hardware process using the ASIC 98, thereby controlling each unit of the printer 10. Units described here are the image forming unit 23, the fixing unit 25, and the optional device 13 described above and the like. In the ROM 95, a control program, various types of data, and the like are stored. For example, in the ROM 95, data such as a maximum sheet length that can be reversed, which will be described later, and the like is stored. The RAM 97 is used as an operation memory that is used when the CPU 93 performs various processes. The timer 99 measures an elapsed time from timing when a downstream-side end portion of a sheet P in the first conveyance direction E passes through the branching point A1. The timer 99 may be realized by software as the CPU 93 executes a predetermined program or hardware. The controller 91 may be configured to include one of the CPU 93 and the ASIC 98.

The printer main body 11 also includes a first motor 101 and a second motor 102 as drive sources. The first and second motors 101 and 102, for example, are stepping motors and transfer drive forces to the conveyance roller 32 and the like through a gear not illustrated in the drawing. The first motor 101, for example, drives the sheet feeding rollers 31, 45, and 47, the conveyance rollers 32 and 65, the registration roller 33, the photosensitive drum 59, the heating roller 61, the second circulation rollers 73, 74, and 75, and the like to rotate. The second motor 102, for example, drives the first discharge and reverse roller 67 and the second discharge and reverse roller 68 disposed in the discharge and reversal path 17 and the first circulation roller 71 of the circulation path 18 to rotate.

The controller 91 forwardly rotates or reversely rotates the first and second discharge and reverse rollers 67 and 68, for example, by changing the rotation speed of the second motor 102. The controller 91 causes the rotation speed of reverse rotation drive to be higher than the rotation speed of the forward rotation drive of the first and second discharge and reverse rollers 67 and 68 (an example of a conveyance speed changing process). Accordingly, the conveyance speed toward the second conveyance direction R illustrated in FIG. 1 is higher than the conveyance speed toward the first conveyance direction E. The first circulation roller 71 rotates in linkage with the first and second discharge and reverse rollers 67 and 68 and conveys a sheet P to the circulation path 18 at the same conveyance speed.

The printer 10 according to this embodiment conveys a sheet P at conveyance speeds that are different at positions in the conveyance path 15 by controlling the first motor 101 and the second motor 102. In description presented below, the conveyance speed in the discharge path 16 and the conveyance speed in the discharge and reversal path 17 at the time of forward rotation drive will be assumed to be a first conveyance speed V1. The first conveyance speed V1 is adjusted by changing the rotation speed of the registration roller 33 or the rotation speed of the first discharge and reverse roller 67 at the time of forward rotation by the controller 91 controlling the first motor 101. In addition, the conveyance speed in the discharge and reversal path 17 at the time of reverse rotation drive and the conveyance speed of the first circulation roller 71 are assumed to be a second conveyance speed V2. The second conveyance speed V2 is adjusted by changing the rotation speed of the first discharge and reverse roller 67 and the like at the time of reverse rotation drive by the controller 91 controlling the second motor 102. A conveyance speed in the circulation path 18 according to the second circulation rollers 73, 74, and 75 is assumed to be a third conveyance speed V3. The third conveyance speed V3 is adjusted by the controller 91 controlling the first motor 101.

The printer main body 11 also includes a display unit 105 that displays various types of information. The display unit 105, for example, has a configuration in which a capacitance-type touch panel and a display panel of a liquid crystal display type overlap each other in a thickness direction and is configured such that various input operations can be performed by pressing and operating operation keys displayed on the touch panel. The controller 91 changes a display content of the display panel or provides a copy function or a facsimile function in accordance with a content of an operation instruction from a user for the touch panel of the display unit 105. The printer main body 11 also includes an external interface 107 connected to the optional devices 13 and 14. The controller 91 controls the optional devices 13 and 14 through the external interface 107.

Figure 3:
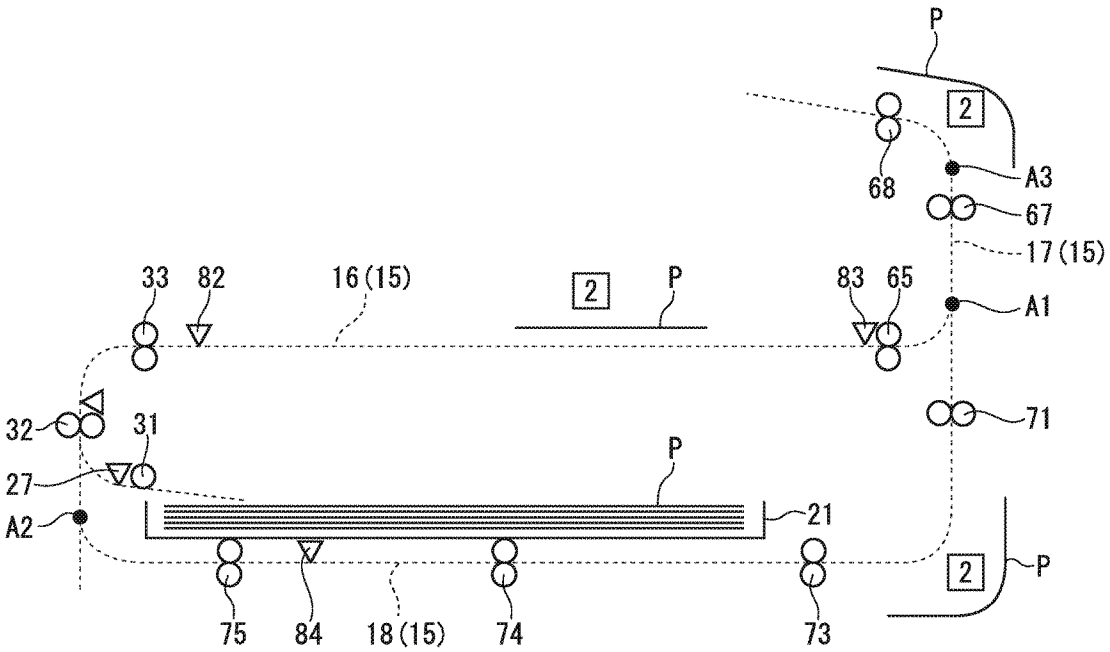
FIG. 3 is a schematic diagram that illustrates a state of a reversed sheet.

Next, an example of a control content of a double-sided printing process will be described. FIG. 3 illustrates the conveyance path 15 illustrated in FIG. 1 in a simplified manner. In the drawing, a mark in which a number enclosed by a square represents that an image of a page of the number is printed on a face of a sheet P disposed on a side to which the number is assigned.

As illustrated in FIGS. 1 and 3, the controller 91 feeds a sheet P, for example, from the main body sheet feeding tray 21 and conveys the sheet P to the image forming unit 23 in accordance with a print job or the like input from a user. At this time, a rear face of the sheet P is brought into contact with the photosensitive drum 59. The rear face described here is a lower face at the time of housing the sheet P in the main body sheet feeding tray 21.

The controller 91 conveys the sheet P on the belt unit 55 toward the rear and transfers a toner image formed on the photosensitive drum 59 of each image forming unit 53 onto the sheet P. The controller 91 conveys the sheet P onto which toner images have been transferred to the fixing unit 25, and the toner images are thermally fixed to the sheet P by the fixing unit 25. The controller 91 passes the sheet P that has passed through the fixing unit 25 through the branching point A1, conveys the sheet to the upper side along the discharge and reversal path 17, conveys the sheet up to a position in contact with the second discharge and reverse roller 68, and stops the sheet. The rear end (an example of an end portion on the upstream side in the first conveyance direction) of the sheet P is located at a position that is disposed between the first discharge and reverse roller 67 and the second discharge and reverse roller 68 and approaches the first discharge and reverse roller 67. The position of the rear end of the sheet P in this stopped state is set as a reversal position A3 (see FIG. 3). In the case of single-side printing, in a step in which the sheet P is conveyed up to the second discharge and reverse roller 68, the sheet P is discharged to the sheet discharging tray 19 through the discharge port 11B based on forward rotation drive of the second discharge and reverse roller 68.

Next, the controller 91 controls the first and second discharge and reverse rollers 67 and 68 to reversely rotate, thereby conveying the sheet P to the circulation path 18. The controller 91 conveys the sheet P up to the image forming unit 23 through the circulation path 18 and the discharge path 16. At this time, the front face of the sheet P is brought into contact with the photosensitive drum 59. The front face described here is an upper face at the time of housing the sheet P in the main body sheet feeding tray 21. Thereafter, the controller 91, similar to the rear face printing process, prints an image on the front face using the image forming unit 23 and the fixing unit 25, thereby forming an image on any one of the front face and the rear face of the sheet P.

The controller 91 according to this embodiment can perform a printing process (an example of a consecutive image forming process), for example, of a 21 method, a 2413 method, and a 2416385 method as printing methods of double-sided printing. According to the 21 method, printing of the rear face and printing of the front face are consecutively performed for each one sheet P consistently from the start to the end of the printing. For example, when a print job for printing two sheets P1 and P2 is received from a user in a printing system of the 21 method, the controller 91 performs printing in the following order.

Printing an image of a second page on the rear face of a first sheet P1.

Printing an image of a first page on the front face of the first sheet P1 and discharging the first sheet P1.

Printing an image of a fourth page on the rear face of a second sheet P2.

Printing an image of a third page on the front face of the second sheet P2 and discharging the second sheet P2.

In this 21 method, the printer 10 does not perform printing of another sheet P2 until the front face of the sheet P1 is printed after printing the rear face of the first sheet P1. In a case where not only the main body sheet feeding tray 21 but also the optional devices 13 and 14 are selected, the controller 91 performs a similar double-sided printing process.

In the 2413 method, an operation of consecutively printing images on the rear faces of two sheets P1 and P2 and then consecutively printing images on the front faces of the sheets P1 and P2 is repeatedly performed. For example, when a print job for printing two sheets P1 and P2 is received from a user in the printing system of the 2413 method, the controller 91 performs printing in the following order.

Printing an image of a second page on the rear face of a first sheet P1.

Printing an image of a fourth page on the rear face of a second sheet P2.

Printing an image of a first page on the front face of the first sheet P1 and discharging the first sheet P1.

Printing an image of a third page on the front face of the second sheet P2 and discharging the second sheet P2.

Figure 4:
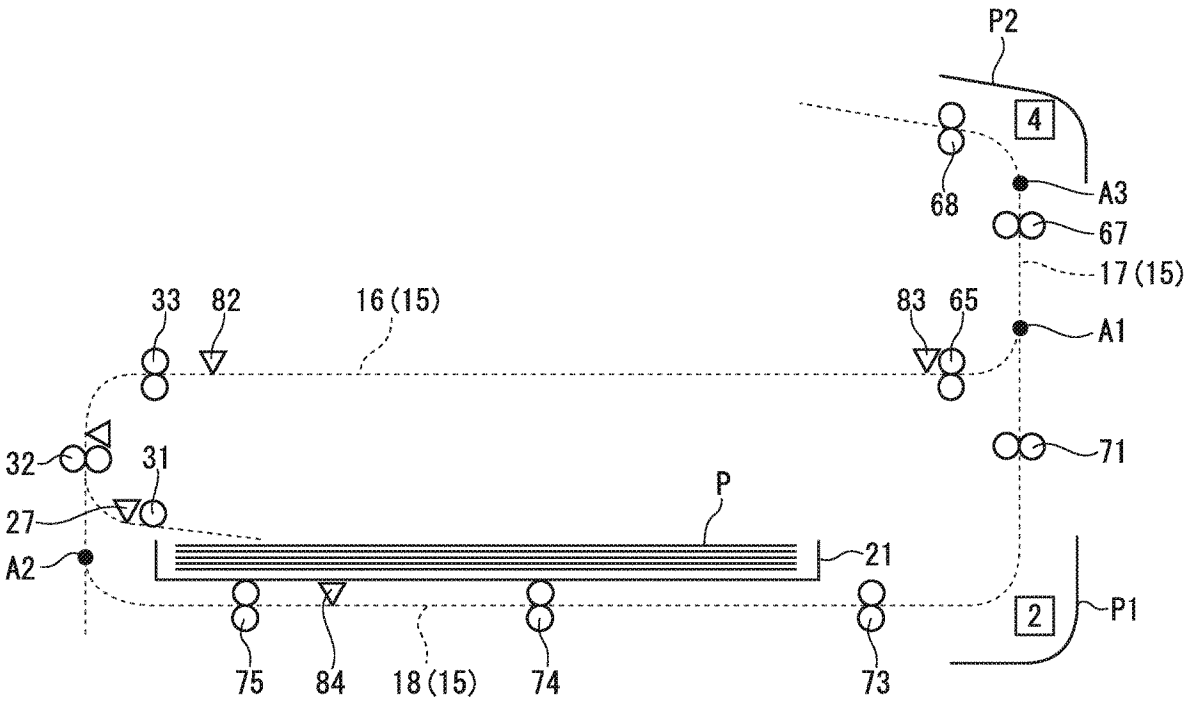
FIG. 4 is a schematic diagram that illustrates a state in which a sheet, on which an image of a fourth page is printed, is stopped at a reversal position in a case where the image is printed using a 2413 method.

For example, as illustrated in FIG. 4, an image of a fourth page is printed, and, in a state in which the sheet P2 is stopped at the reversal position A3, the sheet P1 of the first page having the image of the second page printed on the rear face thereof is present within the circulation path 18. In other words, in the conveyance path 15, two sheets P1 and P2 are present. Accordingly, the throughput of the double-sided printing can be improved.

According to the 2416385 method, after the rear face of one sheet P is printed, until the front face of the one sheet P is printed, an operation of printing a new sheet P all the time is repeatedly performed. For example, when a print job for printing five or more sheets P1 to P5 is received from a user in the printing system of the 2416385 method, the controller 91 performs printing in the following order.

Printing an image of a second page on the rear face of a first sheet P1.

printing an image of a fourth page on the rear face of a second sheet P2.

Printing an image of a first page on the front face of the first sheet P1 and discharging the first sheet P1.

Printing an image of a sixth page on the rear face of a third sheet P3.

Printing an image of a third page on the front face of the second sheet P2 and discharging the second sheet P2.

Printing an image of an eighth page on the rear face of a fourth sheet P4.

Printing an image of a fifth page on the front face of the third sheet P3 and discharging the third sheet P3.

Printing an image of a tenth page on the rear face of a fifth sheet P5.

Printing an image of a seventh page on the front face of the fourth sheet P4 and discharging the fourth sheet P4.

(Hereinafter, a similar printing process is repeated)

Figure 5:
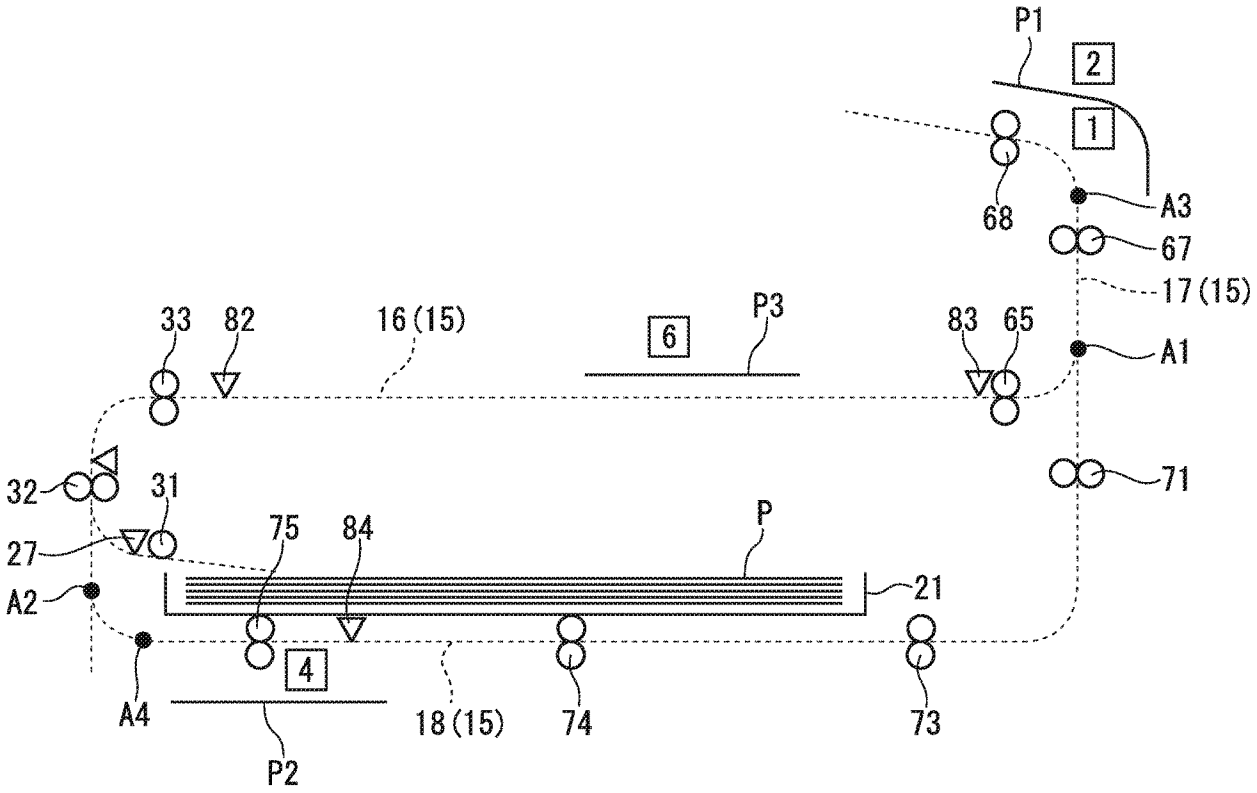
FIG. 5 is a schematic diagram that illustrates the state of a sheet on which an image of a sixth page is printed on a rear face of a third sheet in a case where printing is performs using a 2416385 method.

For example, as illustrated in FIG. 5, in a state in which the image of the sixth page is printed on the sheet P3, double-sided printing is completed for the sheet P1, and the sheet P1 is discharged. The sheet P2 having the image of the fourth page printer on the rear face thereof is stopped within the circulation path 18 by the second circulation roller 75. Accordingly, the controller 91 suppresses a collision between the sheet P2 and the sheet P3. In description presented below, the position of the front end (an end portion on the downstream side in the second conveyance direction R) of the stopped sheet P2 is assumed to be a standby position A4. In the conveyance path 15, temporarily, three sheets P1, P2, and P3 are present. In this way, compared to the 2413 method, the throughput of the double-sided printing can be improved further.

Next, a sheet interval adjustment process performed by the controller 91 performed at the time of double-sided printing will be described with reference to FIGS. 6 to 13. For example, every time when a sheet P disposed in one of the main body sheet feeding tray 21 and the sheet feeding trays 41 and 42 is fed to the image forming unit 23, the controller 91 starts a process according to a flowchart illustrated in FIGS. 6 and 7.

Figure 6:
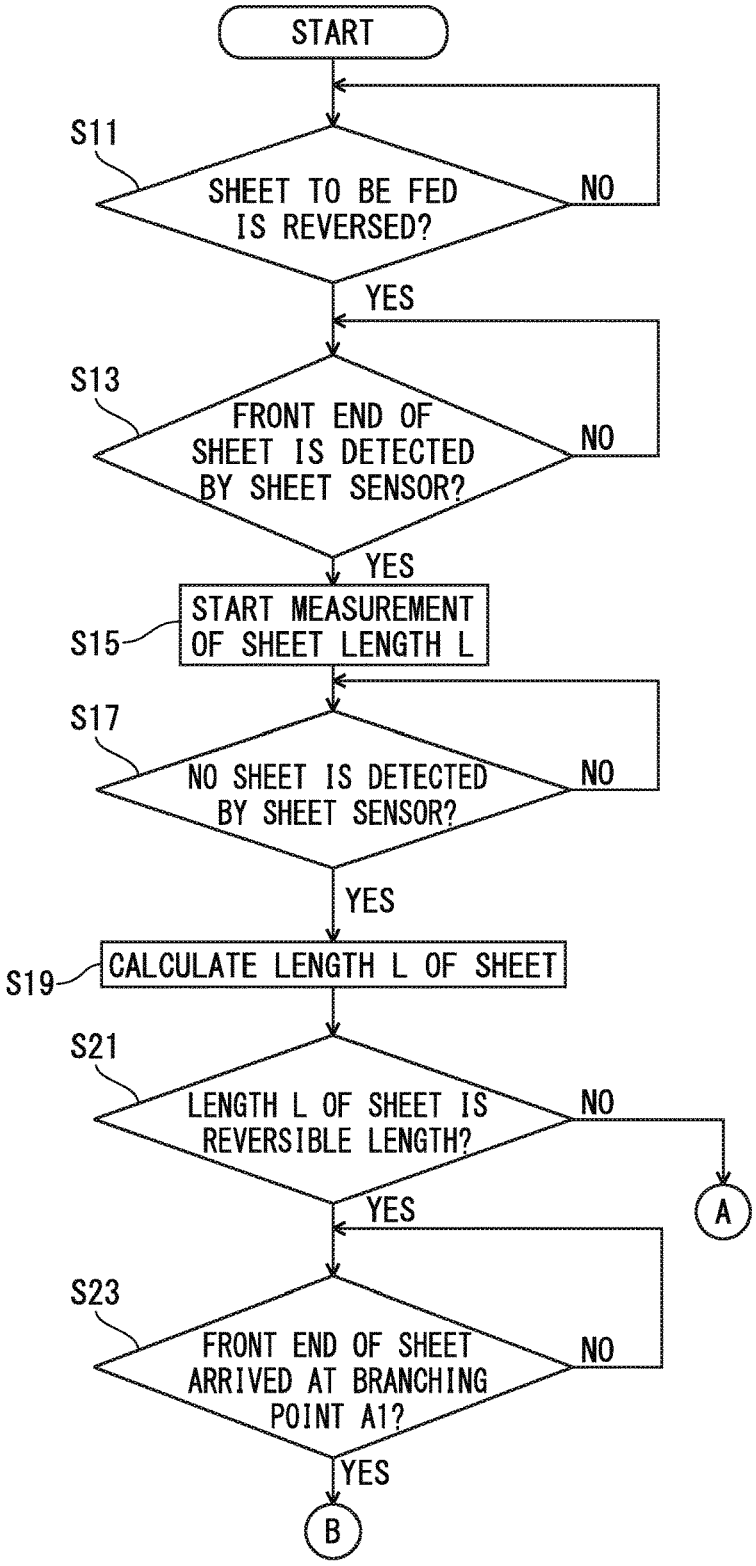
FIG. 6 is a flowchart that illustrates the sequence of a sheet interval adjustment process performed by a control apparatus.

First, the controller, in a step (hereinafter, simply referred to as "S") 11 illustrated in FIG. 6, the controller 91 determines whether or not a sheet P fed to the image forming unit 23 is to be reversed. For example, based on a printing system or the like set in a print job, the controller 91 determines reversal/no-reversal of the sheet P to be fed. In a case where the reversal of the sheet P to be fed is determined not to be performed (S11: No), the controller 91 does not perform the sheet interval adjustment process for the sheet P. The sheet P that is not a reversal target is discharged without reversal in the discharge and reversal path 17 and thus is not a target for the adjustment of a sheet interval from a following sheet.

Next, in a case where the reversal of the sheet P to be supplied is determined to be performed (S11: Yes), the controller 91 measures a sheet length L in the conveyance direction in S13 to S19 (an example of a sheet length detecting process). The sheet P, which is a supply target, to be reversed described here is an example of a first sheet according to the present disclosure. The controller 91 measures the sheet length L using the sheet sensor 82 arranged on the downstream side of the registration roller 33. First, the controller 91, in S13, determines whether or not a front end of a sheet P that is a supply target has been detected by the sheet sensor 82. Until detection of the front end of the sheet P is determined by the sheet sensor 82 (S13: No), the controller 91 performs the process of SI 3 every predetermined time.

In a case where the detection of a front end of a sheet P that is a supply target is determined by the sheet sensor 82 (S13: Yes), the controller 91 starts a process of measuring a sheet length L (S15). For example, when a signal of a high level representing a detection state is input from the sheet sensor 82, the controller 91 starts time measurement using the timer 99 (see FIG. 2).

Next, the controller 91 determines whether or not a sheet P that is a supply target cannot be detected by the sheet sensor 82 (S17). Until a sheet P is not detected by the sheet sensor 82 (S17: No), the controller 91 performs the process of S17 for every predetermined time.

When a sheet P is not detected by the sheet sensor 82 (S17: Yes), the controller 91 calculates a sheet length L (S19). The sheet length L can be acquired by multiplying a time required for passing through the sheet sensor 82 by the first conveyance speed V1 of the sheet P. Accordingly, for example, the controller 91 ends time measurement using the timer 99 in S17 and can calculate a sheet length L based on a time during which a signal of the high level is input from the sheet sensor 82 and the first conveyance speed V1 of the sheet P.

The method of calculating a sheet length L is not limited to the method described above. Thus, a sheet length L may be calculated based on a time until the process of S19 is started after the start of the process of S15 and the first conveyance speed V1. The sensor detecting a sheet length L is not limited to the sheet sensor 82, but any other sensor 82 such as the sheet sensor 81 or the sheet sensor 83 may be used. In such a case, since the sheet sensor 83 is located on the downstream side of the image forming unit 23 and the fixing unit 25, there is concern that the detection accuracy is decreased due to the influence of heat applied to toner attached to the sheet P or the sheet P. For this reason, it is preferable to use the sheet sensor 82 or the like detecting a sheet P before image formation as the sensor detecting a sheet length L.

Next, the controller 91 determines whether or not the detected sheet length L is a reversible length (S21). For example, a maximum sheet length that is reversible in the printer 10 is set in advance in the ROM 95 of the controller 91. In a case where the calculated sheet length L is determined to be larger than the maximum sheet length (S21: No), the controller 91, for example, ends the process for the sheet P that is the supply target, prints only one face, and discharges the sheet (an example of a discharge process). In addition, the controller 91 may display an indication representing that double-sided printing cannot be performed on the display unit 105.

After passing through the position of the sheet sensor 82, the sheet P has an image printed thereon by the image forming unit 23 and the fixing unit 25 and is conveyed up to the branching point A1. On the other hand, in a case where the sheet length L is determined to be the maximum sheet length or less in S21 (S21: Yes), the controller 91 determines whether or not the front end of the sheet P arrives at the branching point A1 (S23). The determination of S23 is made by the controller 91, for example, based on the number of rotations and the rotation position of the first motor 101. More specifically, the controller 91 can determine timing at which the first motor 101 is rotated in correspondence with a predetermined number of rotations after no-detection of the sheet P, which is acquired by the sheet sensor 82, as timing at which the front end of the sheet P arrives at the branching point A1.

The determination method of S23 is not limited to the method that is based on the number of rotations and the like described above. For example, the controller 91 can determine whether or not the front end of the sheet P arrives at the branching point A1 based on the elapse of a time acquired by dividing a conveyance distance from the sheet sensor 82 to the branching point A1 by the first conveyance speed V1.

Figure 7:
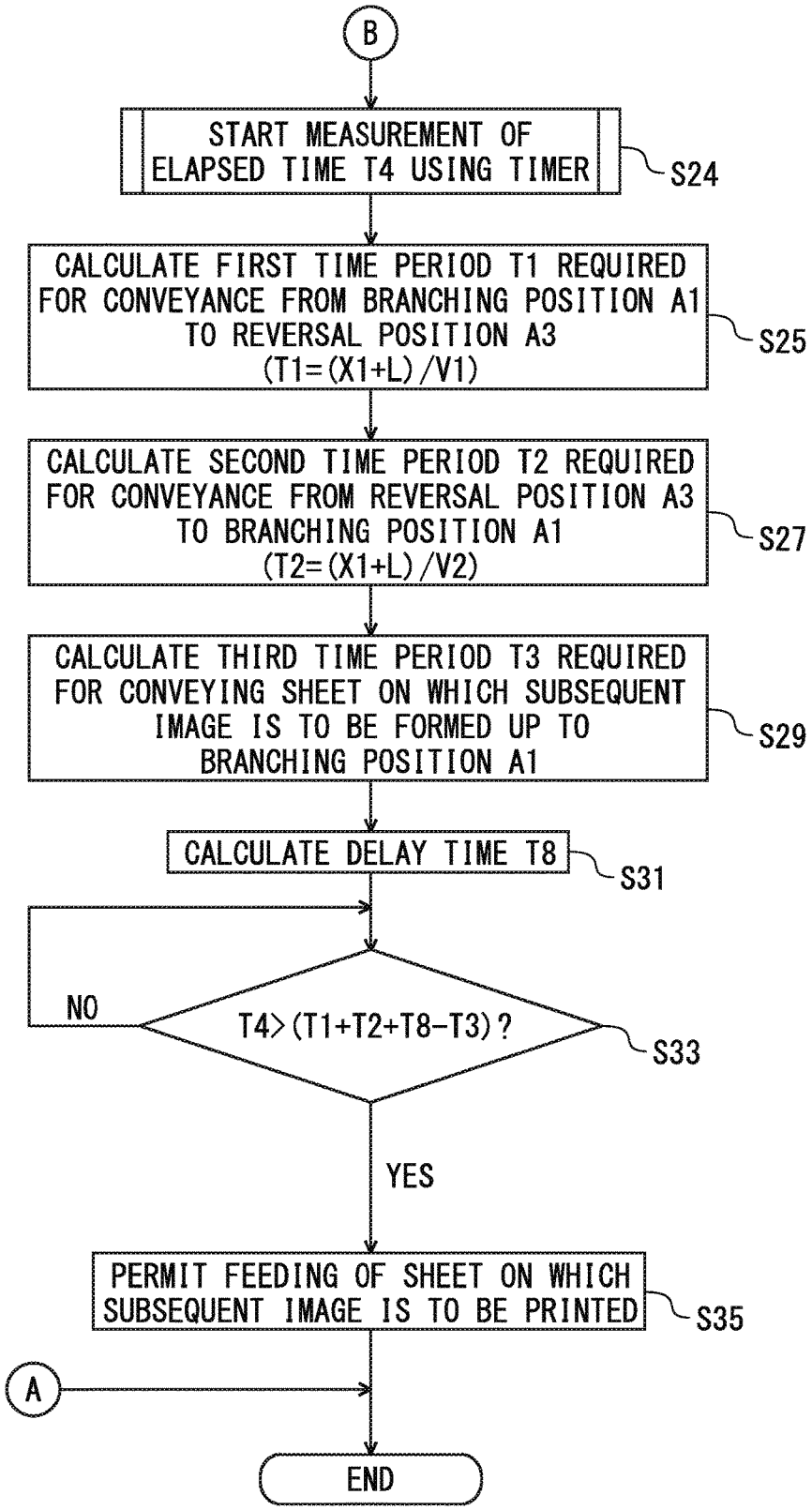
FIG. 7 is a flowchart that illustrates the sequence of the sheet interval adjustment process performed by the control apparatus.

Next, as illustrated in FIG. 7, the controller 91 measures an elapsed time T4 after the sheet P1 passes through the branching point A1 using the timer 99 (S24; an example of an elapsed time measuring process). The process of measuring the elapsed time T4 using the timer 99, for example, is performed by a sub routine program different from that of the sheet interval adjustment process illustrated in FIGS. 6 and 7 in a parallel manner.

Figure 8:
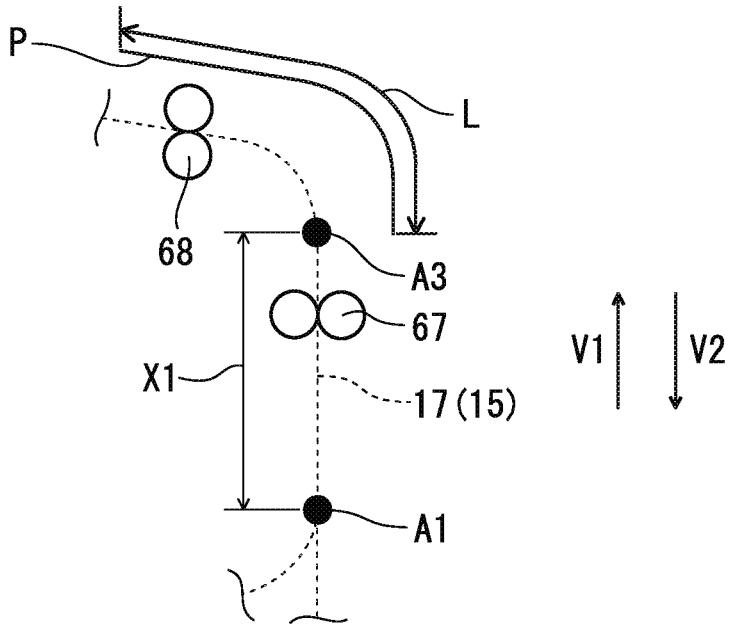
FIG. 8 is a schematic diagram that illustrates a relation between a fourth conveyance distance X1 and a sheet length L.

Next, the controller 91 calculates a first time period T1 required for conveying the sheet P from a state in which the front end (an example of an end portion on the upstream side in the first conveyance direction) is located at the branching point A1 to a state in which the rear end (an example of an end portion on the downstream side in the first conveyance direction) is located at the reversal position A3. The controller 91 performs the calculation of the first time period T1 using an equation taking the sheet length L calculated in S19 into consideration (S25; an example of a first time period calculating process). More specifically, in a case where a conveyance distance (an example of a fourth conveyance distance) between the branching point A1 and the reversal position A3 illustrated in FIG. 8 is X1, and the sheet length is L, the first time period T1 is calculated using the following equation using the first conveyance speed V1 from the branching point A1 toward the reversal position A3.

$$T1=(X1+L)/V1$$

The controller 91, for example, stores the calculated first time period T1 in the RAM 97 (see FIG. 2).

Next, the controller 91 calculates a second time period T2 required for conveying the sheet P from a state in which the front end (an example of an end portion on the downstream side in the second conveyance direction) is located at the reversal position A3 to a state (a state in which the sheet is conveyed to the inside of the circulation path 18) in which the rear end (an example of an end portion on the upstream side in the second conveyance direction) is located at the branching point A1. The controller 91 performs the calculation of the second time period T2 using an equation taking the sheet length L calculated in S19 into consideration (S27; an example of a second time period calculating process). More specifically, the second time period T2 is calculated using the following equation using the second conveyance speed V2 at the time of reverse rotation drive from the reversal position A3 toward the branching point A1 illustrated in FIG. 8, the fourth conveyance distance X1, and the sheet length L.

$$T2=(X1+L)/V2$$

The controller 91, for example, stores the calculated second time period T2 in the RAM 97 (see FIG. 2). In this embodiment, the second conveyance speed V2 is set as a speed higher than the first conveyance speed V1. For this reason, the second time period T2 is a time shorter than the first time period T1.

Next, the controller 91 calculates a third time period T3 required for conveying a sheet P (an example of a second sheet) on which an image is to be formed after the sheet P that is the supply target described above up to the branching point A1 (S29). In description presented below, as an example, in a case where printing is performed using the 2416385 method, three patterns used for calculating the third time period T3 will be described. The controller 91 can calculate the third time period T3 using one of the following three patterns in accordance with the number of times of performing printing in a different printing system.

[First Pattern]

Figure 9:
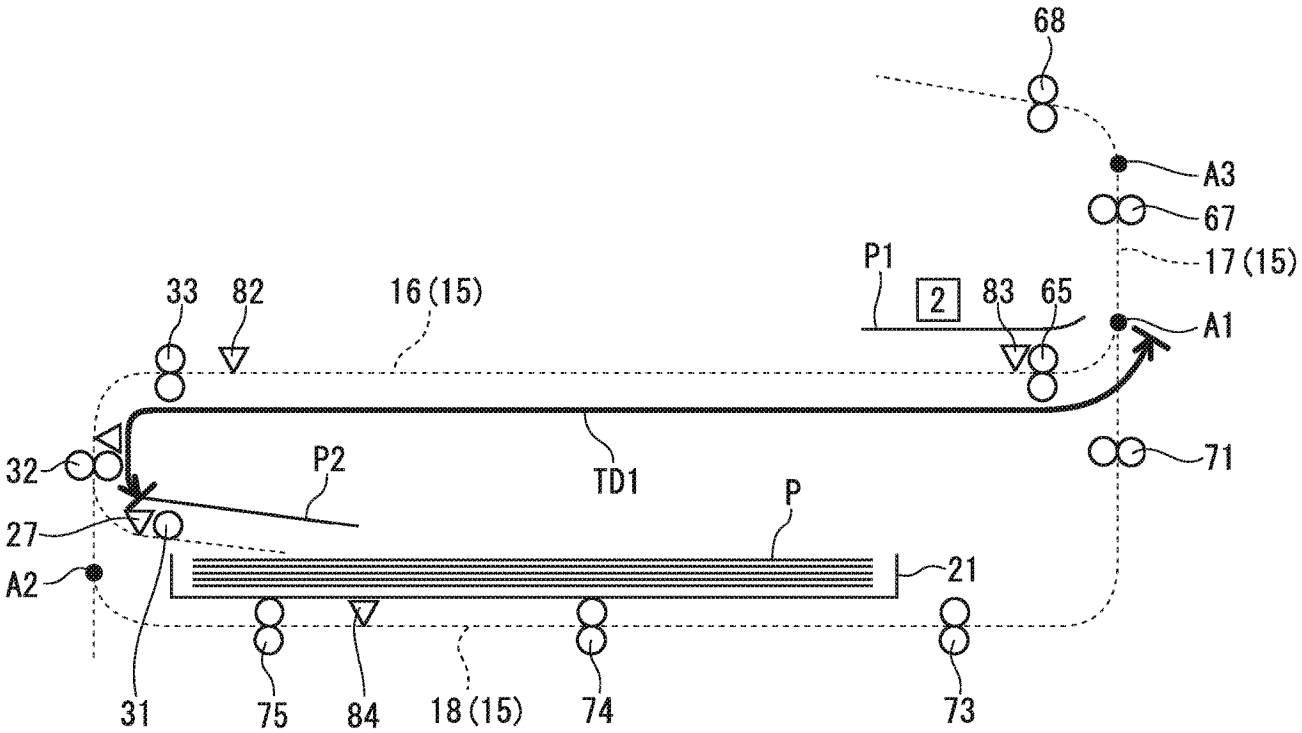
FIG. 9 is a schematic diagram that illustrates a first conveyance distance TD1.

In the 2416385 method, for example, in a case where an image of a second page is printed on the rear face of a first sheet P1, as illustrated in FIG. 9, the controller 91 supplies the sheet P1 that is a supply target from the main body sheet feeding tray 21 and, after an image is printed, conveys the sheet P1 up to the branching point A1. A second sheet P2 on which an image is printed after the supply target is supplied from the main body sheet feeding tray 21. In this case, the controller 91, in S11 described above, determines that reversal of the sheet P1, which is the supply target, is performed (S11: Yes) and thus adjusts supply timing of the sheet P2 to be printed next.

The controller 91, for example, conveys the sheet P2 up to a position detectable using the tray sensor 27 using the sheet feeding roller 31. Meanwhile, the preceding first sheet P1 has an image of the second page printed thereon and arrives at the branching point A1. In this case, a distance required for conveying the P2 on which an image is printed next up to the branching point A1 is a first conveyance distance TD1 from the position (an example of a sheet feeding position) of the tray sensor 27 to the branching point A1. The controller 91 calculates the third time period T3 using the following equation using the first conveyance distance TD1 and the first conveyance speed V1.

$$T3=TD1/V1$$

Figure 10:
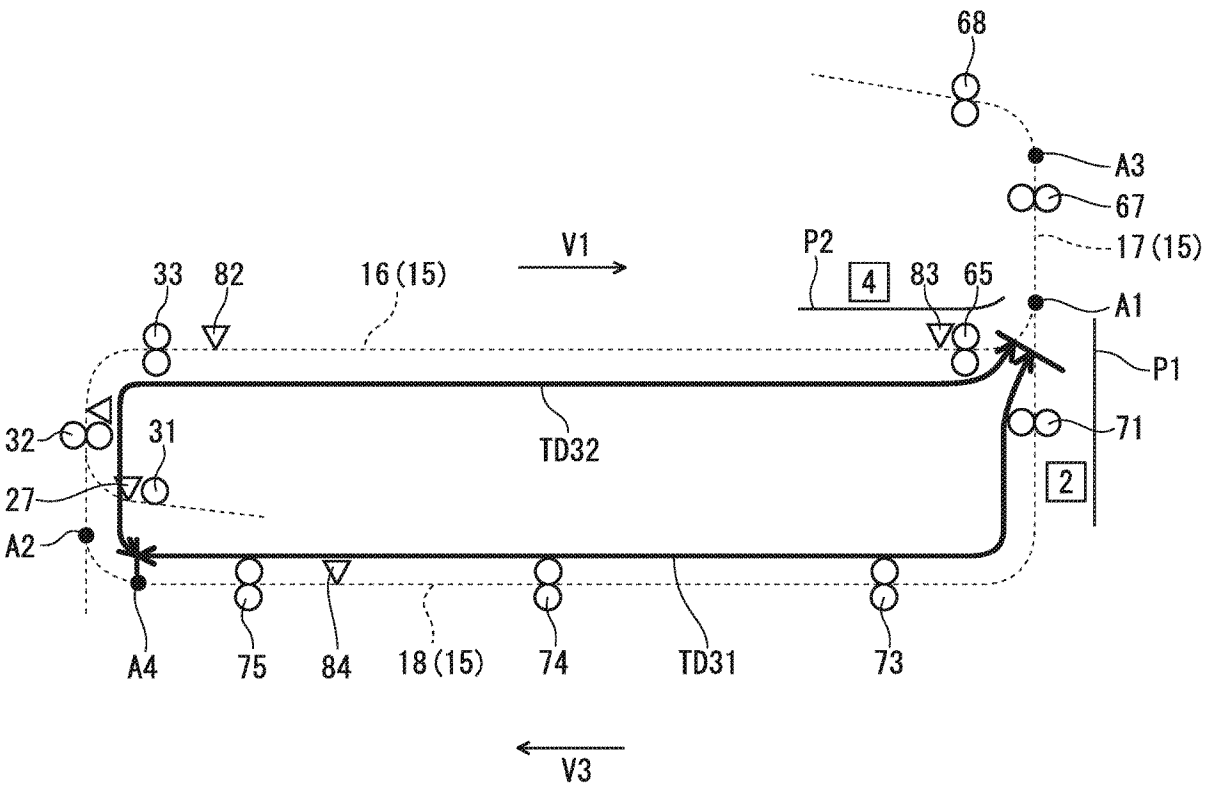
FIG. 10 is a schematic diagram that illustrates conveyance distances TD31 and TD32.

The controller 91, as will be described later, sets supply timing of the sheet P2 using the third time period T3 and adjusts a sheet interval between the sheet P1 that is the supply target and the sheet P2 on which an image is printed next. More specifically, there is concern that the sheet P1 that is conveyed in advance collides with the sheet P2 that is conveyed next when the sheet P1 is reversed in the discharge and reversal path 17. For this reason, the controller 91 adjusts the sheet interval such that only one of the sheets P1 and P2 is present in the discharge and reversal path 17. As illustrated in FIG. 10, in a case where the sheet interval is optimized, at timing when the reversed sheet P1 is conveyed up to a position at which the rear end thereof is located at the branching point A1, the sheet P2 is in a state in which the front end thereof is located at the branching point A1.

[Second Pattern]

FIG. 10 illustrates a state in which an image of a fourth page is printed on the rear face of the second sheet P2. As described above, the sheet P2 is supplied from the main body sheet feeding tray 21 with the sheet feeding timing adjusted and has the image of the fourth page printed on the rear face thereof. In a state in which the rear end of the sheet P1 that is reversed after completing printing in advance is arranged at the branching point A1, the front end of the sheet P2 arrives at the branching point A1.

Here, also when the sheet P2 is supplied from the main body sheet feeding tray 21 for printing an image of a fourth page, the controller 91 starts the process starting from S11 described above. In this case, the sheet P2 becomes a sheet that is the supply target. Meanwhile, the sheet P1 on which the image of the second page has been printed becomes a sheet on which an image is to be printed next. Then, the sheet P1 has the image of the first page printed on the front face thereof and is discharged.

In this case, a distance required for conveying the sheet P1 on which an image is to be printed next up to the branching point A1 is a distance acquired by subtracting the sheet length L from a conveyance distance (an example of a third conveyance distance) for conveying the sheet from the branching point A1 to the branching point A1 through the circulation path 18 and the conveyance path 16. In other words, this conveyance distance is a conveyance distance from the front end of the sheet P1 to the branching point A1 through the circulation path 18 and the like. In this embodiment, a conveyance speed in the conveyance path 16 is different from that in the circulation path 18. For this reason, the controller 91 calculates the third time period T3 using the conveyance speed and a section corresponding thereto.

As illustrated in FIG. 10, in a case where a conveyance distance for conveying a sheet from the branching point A1 to the standby position A4 through the circulation path 18 is denoted by TD31, and a conveyance distance for conveying a sheet from the standby position A4 to the branching point A1 through the discharge path 16 is denoted by TD32, the controller 91 calculates the third time period T3 using the following equation using the first conveyance speed V1, the third conveyance speed V3, and the sheet length L.

$$T3=(TD31-L)/V3+TD32/V1$$

Here, a conveyance distance acquired by adding the conveyance distance TD32 to the conveyance distance TD31 described here is an example of a third conveyance distance according to the present disclosure.

Figure 11:
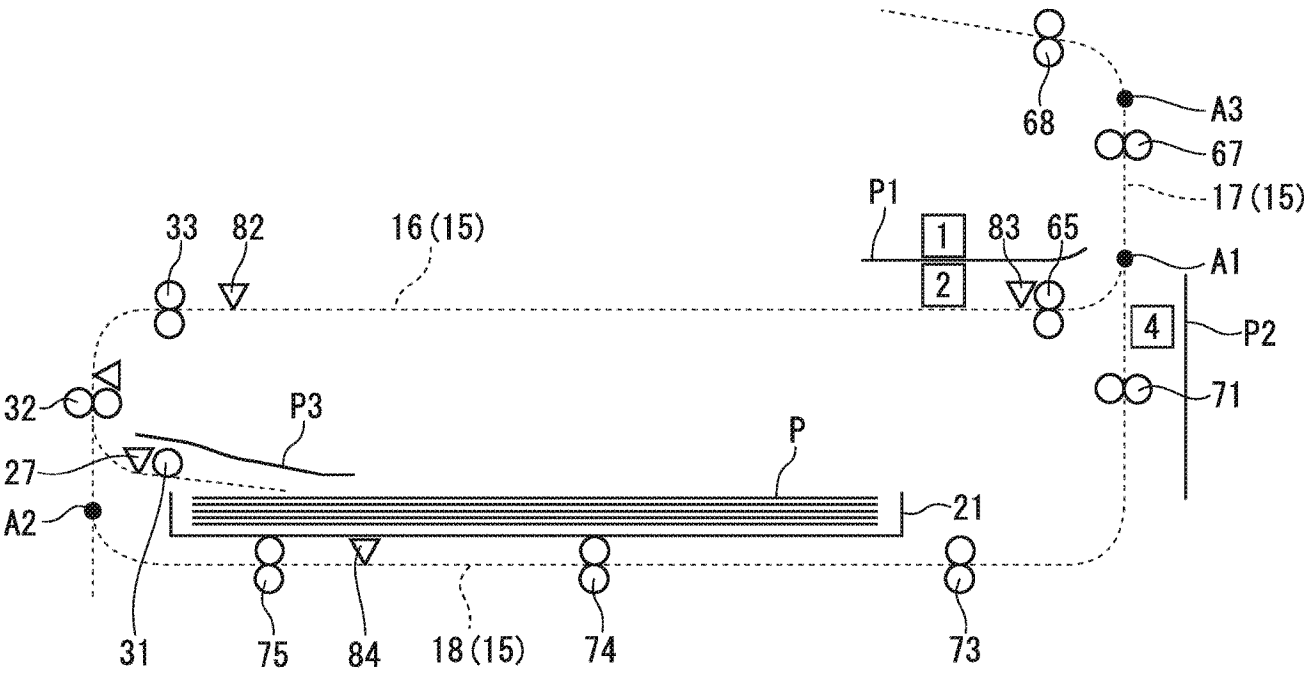
FIG. 11 is a schematic diagram that illustrates states of a sheet P2 on which an image of a fourth page is printed on a rear face and a sheet P1 on which images of first and second pages are printed on both faces in a case where a sheet interval is optimized.

The controller 91 determines timing for conveying the sheet P1 toward the image forming unit 23 using the calculated third time period T3 and adjusts a sheet interval between the sheets P1 and P2. For example, the controller 91 adjusts timings for the standby and conveyance of the sheet P1 at the standby position A4. As illustrated in FIG. 11, the sheet P2 has the image of the fourth page printed on the rear face and is reversed and has the rear end located at the branching point A1. In a case where the sheet interval is optimized, at this timing, the sheet P1 has the images of the first and second pages printed on both faces and has the front end located at the branching point A1.

Next, the double-sided printing for the sheet P1 ends, and the sheet P1 is discharged. In this case, the sheet P1 is fed from a place other than the main body sheet feeding tray 21 and the sheet feeding trays 41 and 42 to the image forming unit 23. For this reason, the controller 91 does not perform the sheet interval adjustment process illustrated in FIGS. 6 and 7 for the sheet P1 at this timing.

In addition, in order to print the image of the sixth page on the rear face, the controller 91 supplies the third sheet P3 from the main body sheet feeding tray 21. In this case, the sheet interval adjustment process is performed for the sheet P3 as a sheet that is a supply target. The sheet P3 that is the sheet feeding target is determined as a sheet to be reversed in S11 described above (S11: Yes). The controller 91 conveys the sheet P3 between the sheets P1 and P2 in the conveyance path 15.

[Third Pattern]

Figure 12:
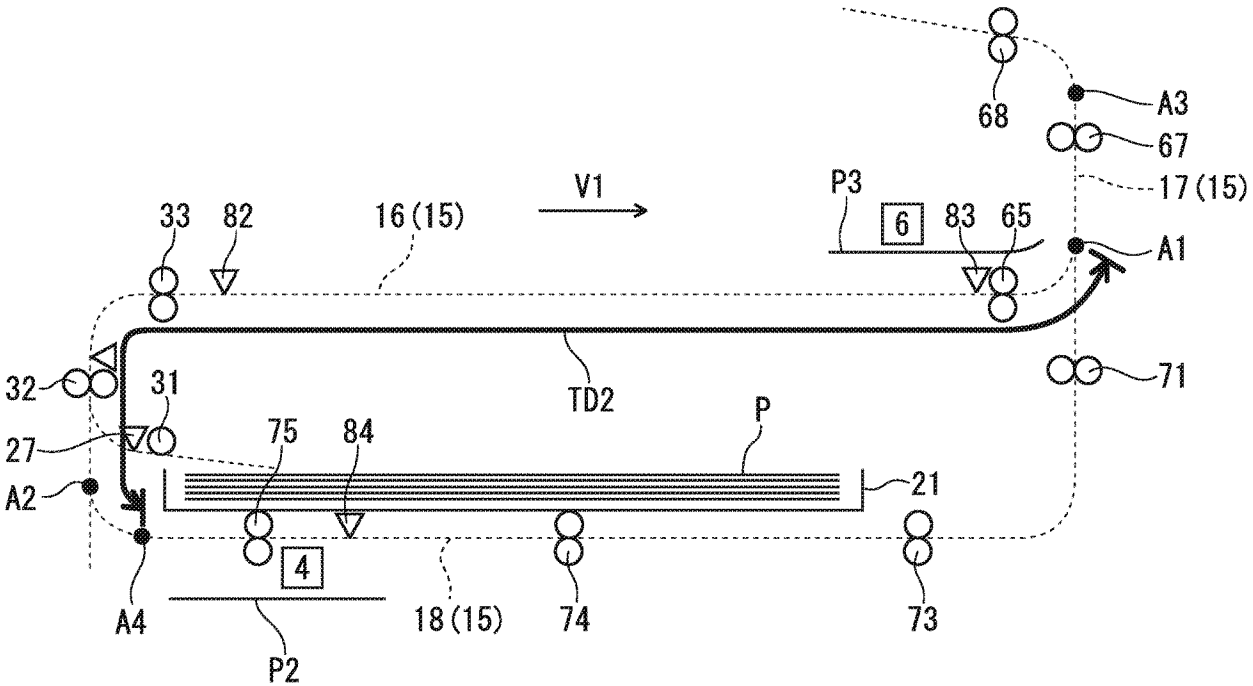
FIG. 12 is a schematic diagram that illustrates a second conveyance distance TD2.

As illustrated in FIG. 12, the controller 91 supplies the sheet P3 that is the supply target from the main body sheet feeding tray 21 and conveys the sheet P3 up to the branching point A1. The second sheet P2 on which an image is to be printed after the supply target is stopped in a state in which the front end is located at the standby position A4. The controller 91 adjusts timing for the supply of the sheet P2 to be printed after the sheet P3 that is the supply target.

In this case, a distance required for conveying the sheet P2 on which an image is to be printed next up to the branching point A1 is a second conveyance distance TD2 from the standby position A4 to the branching point A1 illustrated in FIG. 12. The controller 91 calculates the third time period T3 using the following equation using the second conveyance distance TD2 and the first conveyance speed V1.

$$T3=TD2/V1$$

The controller 91 determines timing for the supply of the sheet P2 using the third time period T3.

The description will be continued with reference to the flowchart illustrated in FIG. 7. After calculating the third time period T3 in accordance with the three patterns described above in S29, the controller 91 calculates a delay time T8 used for delaying the timing for the supply of the sheet P on which an image is to be printed after the sheet feeding target (S31).

Here, the first circulation roller 71 is located on the upstream side of the circulation path 18 and rotates in linkage with the first and second discharge and reverse rollers 67 and 68. For this reason, until the reversed sheet P passes a position in contact with the first circulation roller 71, the rotation directions of the first and second discharge and reverse rollers 67 and 68 cannot be changed from reverse rotation drive to forward rotation drive. In order to change a rotation direction, a desired switching time (an example of a sixth time period) is required. Thus, the controller 91 adjusts the timing for the supply of a sheet P on which an image is to be printed next using a delay time T8 described below.

Figure 13:
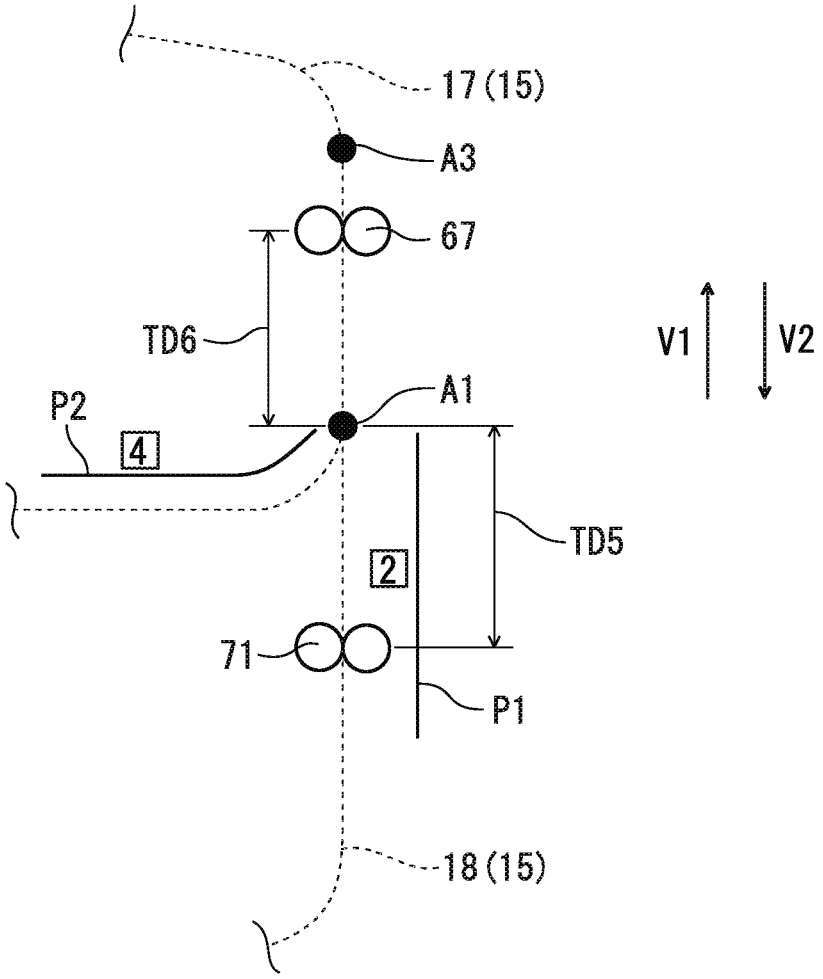
FIG. 13 is a schematic diagram that illustrates a relation between conveyance distances TD5 and TD6.

FIG. 13 illustrates a state in which the image of the second page is printed on the first sheet P1, the first sheet P1 is reversed, and the second sheet P2 is conveyed up to the branching point A1. First, a time period required for conveying the sheet P1 having the rear end located at the branching point A1 up to a position passing the first circulation roller 71 is assumed to be a fifth time period T5. The controller 91 calculates the fifth time period T5 using the following equation using the conveyance distance TD5 between the branching point A1 and the first circulation roller 71 and the second conveyance speed V2 of the first circulation roller 71.

$$T5=TD5/V2$$

A time period required for conveying the sheet P2 having the front end located at the branching point A1 to a position at which the front end is brought into contact with the first discharge and reverse roller 67 is assumed to be a seventh time period T7. The controller 91 calculates the seventh time period T7 using the following equation using the conveyance distance TD6 between the branching point A1 and the reversal position A3 and the first conveyance speed V1.

$$T7=X1/V1$$

A time required for switching the rotation directions of the first and second discharge and reverse rollers 67 and 68 is assumed to be a sixth time period T6. The controller 91 calculates the delay time T8 using the following equation using the fifth time period T5, the sixth time period T6, and the seventh time period T7 described above.

$$T8=T5+T6-T7$$

In the equation described above, (T5+T6) is a time required for switching the rotation of the first and second discharge and reverse rollers 67 and 68 after the sheet P1 is conveyed up to a position not in contact with the first circulation roller 71. Before this time elapses, in a case where the sheet P2 is brought into contact with the first discharge and reverse roller 67 of the discharge and reversal path 17, the sheet P2 is brought into contact with the first discharge and reverse roller 67 that is driven to reversely rotate, and clogging of the sheet or the like occurs.

The sheet P2 passes through the branching point A1 and is conveyed to the discharge and reversal path 17 so as to be interchanged with the sheet P1 passing through the branching point A1 and conveyed to the circulation path 18. The seventh time period T7 is a time period required for conveying the sheet P2 located at the branching point A1 up to the position in contact with the first discharge and reverse roller 67. Thus, a time (T5+T6−T7) is a time for which bringing in the sheet P2 into the discharge and reversal path 17 needs to standby so as to suppress the clogging of the sheet and the like. Thus, the controller 91 sets the time as a delay time T8 (T5+T6−T7). The fifth time period T5, the sixth time period T6, and the seventh time period T7 described above can be calculated in advance. For this reason, the controller 91, in S33, may perform a process of reading and using the delay time T8 stored in the ROM 95 in advance.

Next, the controller 91 determines timing for the supply of a sheet P on which an image is to be printed after the sheet P that is the supply target using the first time period T1, the second time period T2, the third time period T3, and the delay time T8 (S33). The controller 91 compares the elapsed time T4 at which the measurement is started in S24 with (T1+T2+T8−T3) (S33). Here, (T1+T2) is a time required for reversing the sheet P that is the supply target in the discharge and reversal path 17. In a case where a sheet P that is conveyed next to the branching point A1 penetrates the discharge and reversal path 17 within the time (T1+T2), the sheet P collides with the sheet P that is in the middle of the reversal process.

The third time period T3 is a time period required for conveying the sheet P on which an image is to be printed after the sheet P that is the supply target up to the branching point A1. For this reason, (T1+T2−T3) delays timing for conveying a sheet P conveyed later up to the branching point A1 so as not to cause a preceding sheet P and the sheet P conveyed later to collide with each other in the discharge and reversal path 17, in other words, is a time by which the timing for starting the conveyance toward the branching point A1 needs to be delayed. The controller 91 delays supply timing by the delay time T8 that is in consideration of the positional relation between the branching point A1 and the first circulation roller 71 and the like.

In a case where the elapsed time T4 is determined to be (T1+T2+T8−T3) or less (S33: No), the controller 91 repeatedly performs the process of S33 for every predetermined time. On the other hand, in a case where the elapsed time T4 is determined to be more than (T1+T2+T8−T3) (S33: Yes), the controller 91 starts supplying the sheet P on which an image is printed next (S35). In this way, the controller 91 can optimize the sheet interval between two sheets. For example, the controller 91 can cause the front end of the sheet P on which an image is to be formed next to arrive at the branching point A1 at timing when the rear end of the sheet P is reversed in advance is located at the branching point A1.

In the embodiment described above, the main body sheet feeding tray 21, the sheet feeding trays 41 and 42, and the sheet feeding rollers 31, 45, and 47 represent an example of a supply device. The first circulation roller 71 and the second circulation rollers 73, 74, and 75 represents an example of a circulation roller. The first motor 101 is an example of a first drive source. S24 is an example of an elapsed time measuring process. S25 is an example of a first time period calculating process. S27 is an example of a second time period calculating process.

The present invention is not limited to the embodiment described above but may be performed in various forms acquired by making various changes and modifications based on the knowledge of a person skilled in the art.

Figure 14:
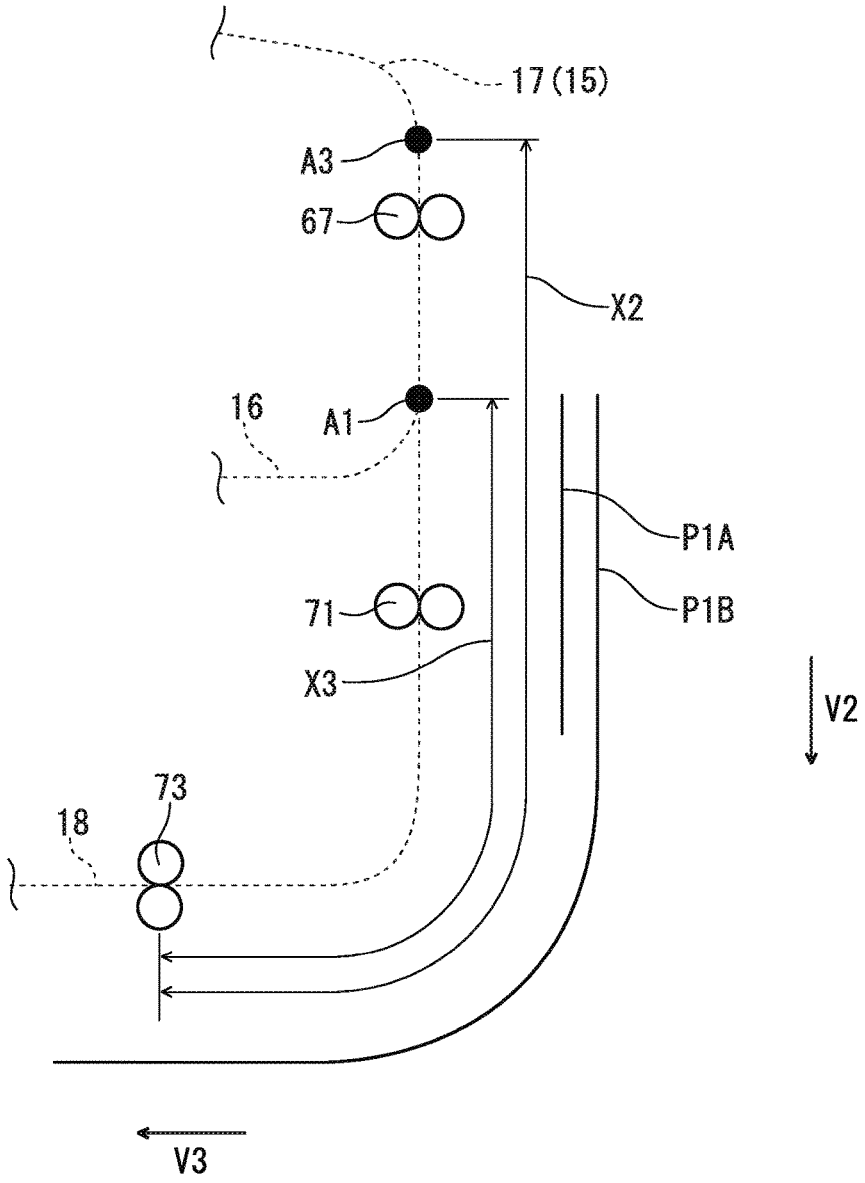
FIG. 14 is a schematic diagram that illustrates a relation between sheets P1A and P1B having mutually-different sheet lengths L and the arrangement of a first circulation roller 71 and a second circulation roller 73.

For example, the controller 91 may correct the second time period T2 and the third time period T3 based on the sheet length L and the positions of the first circulation roller 71 and the second circulation roller 73. FIG. 14 illustrates a relation between sheets P1A and P1B having mutually-different sheet lengths L and the arrangement of the first circulation roller 71 and the second circulation roller 73. Here, the first circulation roller 71 is located on the upstream side (the branching point A1 side) of the circulation path 18, rotates in linkage with the first and second discharge and reverse rollers 67 and 68, and conveys the sheet P at the second conveyance speed V2. The second circulation roller 73 is located on the downstream side of the first circulation roller 71 in the circulation path 18 and conveys the sheet P at the third conveyance speed V3.

A conveyance distance between the branching point A1 and the second circulation roller 73 is assumed to be a sixth conveyance distance X3. The sheet length L of the sheet P1A illustrated in FIG. 14 is shorter than the sixth conveyance distance X3. In this case, the front end of the sheet P1A having the rear end arranged at the branching point A1 does not arrive up to the second circulation roller 73. Accordingly, until the rear end passes through the branching point A1, the sheet P1A can be conveyed at the second conveyance speed V2.

On the other hand, the sheet length L of the sheet P1B illustrated in FIG. 14 is longer than the sixth conveyance distance X3. In this case, the front end of the sheet 1B having the rear end arranged at the branching point A1 is brought into contact with the second circulation roller 73. In a case where the front end of the sheet 1B is brought into contact with the second circulation roller 73, the sheet P1B needs to be conveyed at the third conveyance speed V3 that is the conveyance speed of the second circulation roller 73. For this reason, for example, the controller 91 needs to stop the first circulation roller 71 conveying a sheet at a different speed of the second conveyance speed V2. In other words, the controller 91 can convey the sheet P1B at the second conveyance speed V2 in a conveyance path from the reversal position A3 to the second circulation roller 73. The controller 91 needs to convey the sheet P1B at the third conveyance speed V3 after the conveyance up to the second circulation roller 73.

Figure 15:
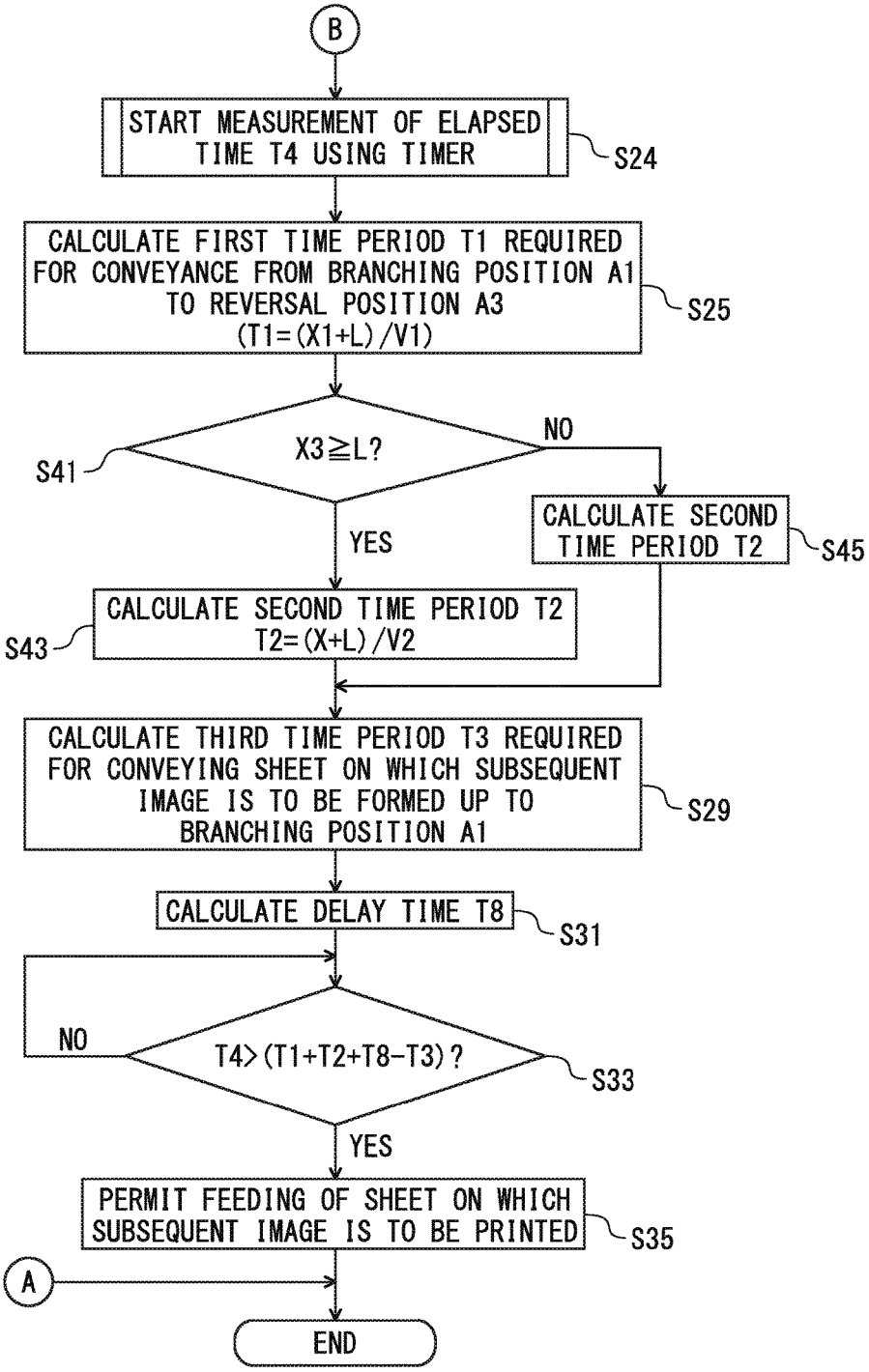
FIG. 15 is a flowchart of a sheet interval adjustment process of another example and is a flowchart that illustrates the sequence for calculating a second time period T2 in a calculation equation according to a magnitude relation between a sixth conveyance distance X3 and a sheet length L.

FIG. 15 illustrates a flowchart for calculating the second time period T2 using a calculation equation according to a result of the comparison between the sixth conveyance distance X3 and the sheet length L. In description presented with reference to FIG. 15, a content similar to the description of the embodiment presented above with reference to FIG. 7 will not be presented as is appropriate.

After calculating the first time period T1 in S25 illustrated in FIG. 7, the controller 91 compares the sixth conveyance distance X3 with the sheet length L calculated in S19 (see FIG. 6) (S41). In a case where the sixth conveyance distance X3 is determined to be the sheet length L or more (S41: Yes), the controller 91, similar to the embodiment described above, calculates a second time period T2 using the following equation (S43; an example of a second time period measuring process).

$$T2=(X1+L)/V2$$

On the other hand, in a case where the sixth conveyance distance X3 is determined to be less than the sheet length L (S41: No), the controller 91 calculates the second time period T2 using the following equation using a fifth conveyance distance X2 between the reversal position A3 and the second circulation roller 73 and the sixth conveyance distance X3, the second conveyance speed V2, and the third conveyance speed V3 described above (S45; an example of a second time period measuring process).

$$T2=X2/V2+(L-X3)/V3$$

After performing S43 or S45, the controller 91 performs the process of S29 and subsequent steps using the calculated second time period T2.

A first term of the equation described above represents a time period required for conveying the sheet 1B from the reversal position A3 to the position of the second circulation roller 73. In this state, the sheet P1B is in a state in which the front end is brought into contact with the second circulation roller 73, and the rear end is arranged within the discharge and reversal path 17 (a position located on a further upstream side than the branching point A1). A second term of the equation described above is a time period required for conveying the rear end of the sheet P1B up to the position of the branching point A1 after being brought into contact with the second circulation roller 73. In this way, in a case where the magnitude relation between the sheet length L and the sixth conveyance distance X3 is determined, the controller 91 selects a calculation equation in accordance with a result of the determination, whereby a more appropriate second time period T2 can be calculated.

Similarly, in a case where the magnitude relation between the sheet length L and the sixth conveyance distance X3 is determined, the controller 91 may correct the third time period T3 calculated in correspondence with the second pattern of the embodiment described above based on a result of the determination. For example, in a case where the sixth conveyance distance X3 is determined to be the sheet length L or more, the controller 91, similar to the second pattern of the embodiment described above, calculates the third time period T3 using the following equation.

$$T3=(TD31-L)/V3+TD32/V1$$

On the other hand, in a case where the sixth conveyance distance X3 is determined to be less than the sheet length L, the controller 91 sets a conveyance distance between the second circulation roller 73 and the standby position A4 (see FIG. 5) as TD7 and calculates the third time period T3 using the following equation using the sixth conveyance distance X3 and the second conveyance speed V2 described above.

$$T3=(X3-L)/V2+TD7/V3+TD32/V1$$

A first term of the equation described above represents a time period required for conveying the rear end of the sheet P1B to the position of the branching point A1 after being brought into contact with the second circulation roller 73. A second term represents a time period required for conveying the sheet from the second circulation roller 73 to the standby position A4. In this way, in a case where the magnitude relation between the calculated sheet length L and the sixth conveyance distance X3 is determined, by selecting an equation in accordance with a result of the determination, the controller 91 can calculate a more appropriate third time period T3.

In the embodiment described above, the timer 99 measures the elapsed time T4 after the timing when the end portion of the sheet P disposed on the downstream side in the first conveyance direction E passes through the branching point A1, but the measurement is not limited thereto. For example, the timer 99 may measure an elapsed time T4 after timing when the end portion of the sheet P disposed on the upstream side in the first conveyance direction E passes through the branching point A1.

In S33, while the controller 91 compares the elapsed time T4 with (T1+T2+T8−T3), the comparison is not limited thereto. For example, the controller 91 may compare the elapsed time T4 with (T1+T2). In addition, the controller 91 may perform only one of the addition of the delay time T8 and the subtraction of the third time period T3 for (T1+T2).

In addition, while the controller 91 calculates the sheet length L based on a result of the detection acquired by the sheet sensor 81, the calculation is not limited thereto. For example, the controller 91 may set the sheet length L based on a content of a print job set by the user.

In S21, while the controller 91 performs the process of comparing the sheet length L with the maximum sheet length, the process may not be performed.

In the embodiment described above, while the controller 91, after waiting for the conveyance of the sheet P up to the branching point A1 in S23, calculates the first time period T1 and the like, the calculation timing is not limited thereto. For example, in S19 illustrated in FIG. 6, the first time period T1 and the like may be calculated at a time point when the sheet length L is determined. In such a case, in order to perform calculation using the position of the sheet sensor 81 as the reference, the controller 91 may correct the first time period T1. More specifically, the controller 91 may add a time period required for conveying the sheet from the sheet sensor 81 to the branching point A1 to the first time period T1 as a correction time. Similarly, the controller 91 may correct the third time period T3 by subtracting a time period required for conveying the sheet from the sheet sensor 81 to the branching point A1 from the third time period T3.

In the embodiment described above, the first conveyance speed V1, the second conveyance speed V2, and the third conveyance speed V3 may be configured to be a same speed. In such a case, the rotation speeds of the forward rotation drive and the reverse rotation drive of the first and second discharge and reverse rollers 67 and 68 are the same. In addition, the printer main body 11 may be configured to include only one of the first motor 101 and the second motor 102. Furthermore, only two conveyance speeds among the first conveyance speed V1, the second conveyance speed V2, and the third conveyance speed V3 may be configured to be the same.

In the embodiment described above, while the controller 91 calculates the sheet length L for each sheet P, the calculation is not limited thereto. For example, in a case where sheets P of a same size are consecutively supplied from a same sheet feeding tray, the controller 91 may be set to calculate the sheet length L only at the time of performing first printing. Then, the controller 91 may omit the process of S13 to S19 at the time of printing a second page and subsequent pages.

The image forming apparatus according to the present disclosure is not limited to a laser printer but may be an ink jet printer. Furthermore, the image forming apparatus is not limited to the printer but may be a scanner having no printing function.

As described in the above with reference to the embodiment, according to the present disclosure, there is provided an image forming apparatus including: a conveyance path; a supply device that supplies a sheet to the conveyance path; an image forming unit that forms an image on the sheet conveyed through the conveyance path; a discharge port, a discharge and reverse roller that discharges or reverses the sheet on which the image is formed by the image forming unit from the discharge port; a circulation roller that conveys the sheet reversed by the discharge and reverse roller; and a controller. In a case where a conveyance direction of the sheet conveyed from the image forming unit toward the discharge port is a first conveyance direction, and a direction in which the sheet reversed by the discharge and reverse roller is conveyed toward the circulation roller is a second conveyance direction, the conveyance path includes a branching point that is disposed on a further downstream side in the first conveyance direction than a position of the image forming unit, a merging point that is disposed on a further upstream side in the first conveyance direction than the position of the image forming unit, a discharge path that connects the supply device to the branching point through the image forming unit, a discharge and reversal path that connects the branching point to the discharge port through the discharge and reverse roller, and a circulation path that connects the branching point to the merging point not through the image forming unit but through the circulation roller. The controller performs: a consecutive image forming process in which, in a case where an image is formed by the image forming unit on each face of two sheets, after an image is formed on one face of a first sheet out of the two sheets, until an image is formed on the other face by a reversal of the first sheet, an image is formed on one face of a second sheet; and a sheet interval adjustment process in which in a case where, when a sheet conveyed through the discharge and reversal path in the first conveyance direction is reversed by the discharge and reverse roller, a position at which an end portion of the sheet disposed on an upstream side in the first conveyance direction reaches is a reversal position, a time period required for conveying the end portion of the sheet, which is conveyed in the first conveyance direction, disposed on the upstream side in the first conveyance direction up to the reversal position after an end portion of the sheet disposed on the downstream side or the end portion of the sheet on the upstream side in the first conveyance direction passes through the branching point is a first time period, and a time period required for conveying an end portion of the reversed sheet disposed on an upstream side in the second conveyance direction from the reversal position to the branching point is a second time period, a time difference between the first sheet having the image formed and reversed in the consecutive image forming process and the second sheet on which an image is formed after the first sheet is set to a time longer than a time acquired by adding the first time period and the second time period.

In the image forming apparatus, the conveyance path branches into three paths of the discharge path, the discharge and reversal path, and the circulation path on the downstream side of the image forming unit in the first conveyance direction. The discharge and reversal path connects the branching point to the discharge port through the discharge and reverse roller. The discharge and reverse roller reverses a sheet within the discharge and reversal path. In other words, the discharge and reversal path is used to be common to both a case where the sheet is discharged and a case where the sheet is reversed. For this reason, by shortening the entire length of the path, a decrease in the size of the apparatus can be achieved.

In addition, the controller consecutively performs image formation for two sheets including the first sheet and the second sheet using the image forming unit. The first time period is a time period required for conveying the end portion of a sheet disposed on the upstream side in the first conveyance direction up to the reversal position after the passage of the end portion of the sheet, which is conveyed in the first conveyance direction, disposed on the downstream side in the first conveyance direction or the end portion of the sheet on the upstream side through the branching point. A second time period is a time period required for conveying the end portion of the reversed sheet disposed on the upstream side in the second conveyance direction from the reversal position to the branching point. A total time of the first time period and the second time period corresponds to a time required for reversing the first sheet conveyed from the discharge path to the discharge and reversal path and conveying the first sheet from the discharge and reversal path to the circulation path. In a case where the second sheet penetrates into the discharge and reversal path within the total time, the second sheet collides with the first sheet that is in the middle of a reversal process. Thus, in the image forming apparatus, a time difference between the two sheets is set to a time longer than the total time of the first time period and the second time period. In this way, a collision between the sheets can be suppressed.

In addition, in the image forming apparatus according to the present disclosure, the controller may be configured to perform an elapsed time measuring process in which an elapsed time after the end portion of the first sheet, which is conveyed in the first conveyance direction, disposed on the downstream side or the end portion of the first sheet disposed on the upstream side that is conveyed in the first conveyance direction passes through the branching point is measured and, in the sheet interval adjustment process, convey the second sheet toward the image forming unit in response to timing satisfying $T4>(T1+T2-T3)$ in a case where the first time period is denoted by T1, the second time period is denoted by T2, a time period required for conveying the second sheet from a position located at timing when the measurement of the elapsed time is started to the branching point is a third time period T3, and an the elapsed time is denoted by T4.

When the third time period elapses after the passage of the first sheet through the branching point, the second sheet arrives at the branching point. In other words, the third time period is a time difference between the first sheet arriving at the branching point and the second sheet present at a different position on the path and is a time that can be secured as a sheet interval before the reverse rotation of the first sheet. (T1+T2−T3) is a difference between a time required for reversing the first sheet and conveying the first sheet to the inside of the circulation path and a time period required for conveying the second sheet up to the branching point and is a time to be secured as the sheet interval. Thus, the controller supplies the second sheet after the elapsed time T4 elapses by (T1+T2−T3), whereby a collision between sheets can be suppressed by reliably securing the time of the sheet interval.

In the image forming apparatus according to the present disclosure, in a case where the second sheet is arranged at a supply position of the supply device at the timing when the measurement of the elapsed time is started, the controller may be configured to calculate the third time period in the sheet interval adjustment process, based on a first conveyance distance from the supply position to the branching point.

In a case where the second sheet is supplied from the supply device, the first sheet arriving at the branching point and the second sheet are separate from each other by the first conveyance distance of the supply position to the branching point. For this reason, for example, by setting a time acquired by dividing the first conveyance distance by the conveyance speed as the third time period, the controller can set an appropriate time as the third time period.

In the image forming apparatus according to the present disclosure, in a case where the second sheet is made to stand by at a standby position of the circulation path at the timing when the measurement of the elapsed time is started, the controller may be configured to calculate the third time period in the sheet interval adjustment process, based on a second conveyance distance from the standby position to the branching point.

For example, in a case where images are consecutively formed by conveying three or more sheets within the conveyance path, between a second sheet and a first sheet, there are cases where a third sheet having one face for which image formation has been completed or the like is present. In such cases, the controller reverses the second sheet, discharges the third sheet from the discharge port, and causes the second sheet having one for which image formation has been completed to stand by at the standby position of the circulation path during the reverse rotation of the first sheet, thereby suppressing a collision between the second sheet and the first sheet. Then, by calculating the third time period based on the second conveyance distance between the standby position and the branching point, the controller can set an appropriate time as the third time period.

In the image forming apparatus according to the present disclosure, in a case where an end portion of the second sheet disposed on the upstream side in the second conveyance direction inside the circulation path is located at the branching point at the timing when the measurement of the elapsed time is started, the controller may be configured to calculate the third time period in the sheet interval adjustment process, based on a distance acquired by subtracting a length of the sheet in the conveyance direction from a third conveyance distance for conveyance from the branching point to the branching point passing through the circulation path and the discharge path.

In a case where the sheet interval is optimized, for example, when the end portion of the first sheet disposed on the upstream side in the first conveyance direction is conveyed up to the branching point, the second sheet is at timing when the second sheet is conveyed from the branching point to the circulation path. The end portion of the second sheet disposed on the upstream side in the second conveyance direction is located at the branching point. Thus, by calculating the third time period based on a distance acquired by subtracting the sheet length from the third conveyance distance for the conveyance from the branching point back to the branching point again through the circulation path and the conveyance path, the controller can calculate an appropriate time as the third time period.

In the image forming apparatus according to the present disclosure, the circulation roller may be configured to include a first circulation roller that is disposed on the upstream side in the second conveyance direction in the circulation path and conveys the sheet from the discharge and reversal path to the circulation path by rotating in linkage with the discharge and reverse roller, and in a case where a time period required for conveying the second sheet that is in a state in which the end portion disposed on the upstream side in the second conveyance direction is located at the branching point up to a position at which the end portion disposed on the upstream side in the second conveyance direction passes through the first circulation roller is a fifth time period T5, a time required for switching a rotation direction of the discharge and reverse roller is a sixth time period T6, a time period required for conveying the first sheet that is in a state in which the end portion disposed on the downstream side in the first conveyance direction is located at the branching point up to a position at which the end portion disposed on the downstream side in the first conveyance direction is brought into contact with the discharge and reverse roller is a seventh time period T7, and a time used for delaying timing for conveying the second sheet toward the image forming unit is a delay time T8, the controller may be configured to calculate the delay time using T8=T5+T6−T7 in the sheet interval adjustment process.

The first circulation roller is located on the upstream side (branching point side) in the second conveyance direction in the circulation path and rotates in linkage with the discharge and reverse roller, thereby conveying the sheet reversed in the discharge and reversal path to the inside of the circulation path in cooperation with the discharge and reverse roller. Here, the discharge and reverse roller reverses the rotation direction in a discharge operation and a reversal operation. In addition, the first circulation roller is linked with the discharge and reverse roller and rotates in the same direction. Until the end portion of the second sheet disposed on the upstream side in the second conveyance direction passes through a position in contact with the first circulation roller, the discharge and reverse roller cannot change the rotation direction. In order to perform switching of the rotation direction, a desired switching time (sixth time period) is required. (T5+T6) corresponds to a time required for perform switching of the rotation of the discharge roller after conveying the second sheet up to a position not in contact with the first circulation roller. Before this time elapses, when the first sheet is conveyed to the discharge and reversal path and is brought into contact with the discharge and reverse roller, the first sheet is in contact with the discharge and reverse roller rotating in the opposite direction, and sheet jamming and the like are caused to occur. In contrast to this, the seventh time period is a time period required for conveying the first sheet disposed at the branching point up to a position in contact with the discharge and reverse roller. For this reason, by setting (T5+T6−T7) as the delay time T8, the controller can suppress the occurrence of sheet jamming and the like.

In the image forming apparatus according to the present disclosure, the controller may be configured to perform: a first time period calculating process calculating the first time period using T1=(X1+L)/V1 in the sheet interval adjustment process in a case where the first time period is denoted by T1, a fourth conveyance distance between the branching point and the reversal position is denoted by X1, a speed at which the sheet is conveyed from the branching point to the reversal position in the first conveyance direction is a first conveyance speed V1, and a length of the sheet in the conveyance direction is denoted by L, and a second time period calculating process calculating the second time period using T2=(X1+L)/V2 in a case where the second time period is denoted by T2, and a speed at which the sheet is conveyed from the reversal position to the branching point in the second conveyance direction is a second conveyance speed V2.

In the image forming apparatus, the first time period T1 and the second time period T2 are calculated by taking the length L of the sheet into consideration in addition to the fourth conveyance distance X1, and more appropriate times can be set as the first time period T1 and the second time period T2.

In the image forming apparatus according to the present disclosure may further include a first drive source that drives the discharge and reverse roller, and the controller may be configured to control the first drive source and perform a conveyance speed changing process in which the second conveyance speed is set to be higher than the first conveyance speed by controlling the first drive source.

In the image forming apparatus, by setting the second conveyance speed to be higher than the first conveyance speed, shortening of the operation time required for the reversal can be achieved. In the image forming apparatus having different conveyance speeds, by appropriately setting a time difference between sheets, a collision between sheets can be suppressed.

In the image forming apparatus according to the present disclosure, the circulation roller may be configured to include: a first circulation roller that is disposed on the upstream side in the second conveyance direction in the circulation path and conveys the sheet at the second conveyance speed from the discharge and reversal path to the circulation path by rotating in linkage with the discharge and reverse roller; and a second circulation roller that is disposed on a further downstream side in the second conveyance direction than a position of the first circulation roller and conveys the sheet at a third conveyance speed in the circulation path, and, in the second time period calculating process, in a case where the third conveyance speed is denoted by V3, a fifth conveyance distance between the reversal position and the second circulation roller is denoted by X2, and a sixth conveyance distance between the branching point and the second circulation roller is denoted by X3, the controller may be configured to calculate the second time period using T2=(X1+L)/V2 in accordance with X3≥L and calculates the second time period using T2=X2/V2+(L−X3)/V3 in accordance with X3<L in the second time period calculating process.

The first circulation roller is located on the upstream side (branching point side) in the second conveyance direction in the circulation path and rotates in linkage with the discharge and reverse roller, thereby conveying the sheet reversed in the discharge and reversal path to the inside of the circulation path in cooperation with the discharge and reverse roller. The second circulation roller conveys a sheet at a third conveyance speed V3 different from the conveyance speed of the first circulation roller. In a case where the sixth conveyance distance X3≥the sheet length L, the end portion of the sheet, which has the end portion disposed on the upstream side in the second conveyance direction arranged at the branching point, disposed on the downstream side does not arrive at the second circulation roller. Accordingly, in this case, the sheet can be conveyed at the second conveyance speed V2 until the end portion disposed on the upstream side in the second conveyance direction passes through the branching point.

On the other hand, in a case where the sixth conveyance distance X3<the sheet length L, the end portion of the sheet, which has the end portion disposed on the upstream side in the second conveyance direction arranged at the branching point, disposed on the downstream side is brought into contact with the second circulation roller. For this reason, in a case where the end portion of the sheet disposed on the downstream side is conveyed up to the position of the second circulation roller, the image forming apparatus needs to convey the sheet at the third conveyance speed V3 of the second circulation roller, for example, by stopping the first circulation roller having a different conveyance speed. In other words, the image forming apparatus needs to convey the sheet at the second conveyance speed V2 from the reversal position up to the second circulation roller and convey the sheet at the third conveyance speed after being brought into contact with the second circulation roller. Thus, for example, in a case where the magnitude relation between the sheet length L and the sixth conveyance distance X3 is determined, the controller selects a calculation equation based on a result of the determination, whereby a more appropriate third time period T3 can be calculated.

In addition, the image forming apparatus according to the present disclosure may further include a sheet sensor that detects whether or not the sheet is conveyed on the conveyance path, and the controller may be configured to perform a sheet length detecting process in which the length of the sheet in the conveyance direction is detected based on a time until the sheet is not detected after detection of the sheet using the sheet sensor.

In the image forming apparatus, for example, by multiplying a time from detection to no-detection acquired by the sheet sensor by the conveyance speed, the length of the sheet for which image formation is in the middle of the process can be detected.

In the image forming apparatus according to the present disclosure, the controller may be configured to perform a discharge process in which the sheet is discharged from the discharge port by stopping a process of reversing the sheet in accordance with the length of the sheet detected in the sheet length detecting process being larger than a maximum sheet length that can be reversed by the discharge and reverse roller.

In a case where the detected sheet length is larger than the maximum sheet length, the image forming apparatus can suppress sheet jamming and the like of the sheet by stopping the process of reversing the sheet.

An image forming apparatus according to the present disclosure shortens the length of a conveyance path by overlapping a sheet discharging path and a reversal path with each other and is capable of appropriately controlling a sheet space between a plurality of sheets conveyed to the conveyance path.

While the present disclosure has been described above with reference to the examples and the modified examples, the above-mentioned examples of the present disclosure are provided to facilitate understanding of the present disclosure, but are not provided to limit the present disclosure. The present invention can be modified and improved without departing from the gist and scope of the appended claims, and equivalents thereof belong to the present disclosure.

What is claimed is:

1. An image forming apparatus comprising:

a conveyance path;

a supply device that supplies a sheet to the conveyance path;

an image forming unit that forms an image on the sheet conveyed through the conveyance path;

a discharge port;

a discharge and reverse roller that discharges or reverses the sheet, on which the image is formed by the image forming unit, from the discharge port;

a circulation roller that conveys the sheet reversed by the discharge and reverse roller; and a controller, wherein, in a case where a conveyance direction of the sheet conveyed from the image forming unit toward the discharge port is defined as a first conveyance direction, and a direction in which the sheet reversed by the discharge and reverse roller is conveyed toward the circulation roller is defined as a second conveyance direction, the conveyance path includes:

a branching point that is disposed on a further downstream side in the first conveyance direction than a position of the image forming unit;

a merging point that is disposed on a further upstream side in the first conveyance direction than the position of the image forming unit;

a discharge path that connects the supply device to the branching point through the image forming unit;

a discharge and reversal path that connects the branching point to the discharge port through the discharge and reverse roller; and a circulation path that connects the branching point to the merging point not through the image forming unit but through the circulation roller, and wherein the controller is configured to cause the image forming apparatus to perform:

a consecutive image forming process in which, in a case where an image is formed by the image forming unit on each face of two sheets including a first sheet and a second sheet, an image is formed on a first face of the second sheet during a period after an image is formed on a first face of the first sheet and until an image is formed on a second face of the first sheet by a reversal of the first sheet; and a sheet interval adjustment process in which in a case where, a reversal position is defined at a position at which an end portion of the sheet disposed on an upstream side in the first conveyance direction reaches when a sheet conveyed through the discharge and reversal path in the first conveyance direction is reversed by the discharge and reverse roller, a first time period is defined as a time period required for conveying the end portion of the sheet, which is conveyed in the first conveyance direction, disposed on the upstream side in the first conveyance direction up to the reversal position after an end portion of the sheet disposed on the downstream side in the first conveyance direction passes through the branching point, and a second time period is defined as a time period required for conveying an end portion of the reversed sheet disposed on an upstream side in the second conveyance direction from the reversal position to the branching point, a time difference between the first sheet having the image formed and reversed in the consecutive image forming process and the second sheet on which an image is formed after the first sheet is set to a time longer than a time acquired by adding the first time period and the second time period; and an elapsed time measuring process in which an elapsed time after the end portion of the first sheet, which is conveyed in the first conveyance direction, disposed on the downstream side in the first conveyance direction passes through the branching point is measured, wherein in the sheet interval adjustment process, the controller is configured to cause the image forming apparatus to convey the second sheet toward the image forming unit in response to timing satisfying $T4>(T1+T2-T3)$ in a case where the first time period is denoted by T1, the second time period is denoted by T2, a third time period T3 is defined as a time period required for conveying the second sheet from a position located at timing when the measurement of the elapsed time is started to the branching point, and an the elapsed time is denoted by T4.

2. The image forming apparatus according to claim 1, wherein, in a case where the second sheet is arranged at a supply position of the supply device at the timing when the measurement of the elapsed time is started, the controller calculates the third time period in the sheet interval adjustment process, based on a first conveyance distance from the supply position to the branching point.

3. The image forming apparatus according to claim 1, wherein, in a case where the second sheet is made to stand by at a standby position of the circulation path at the timing when the measurement of the elapsed time is started, the controller calculates the third time period in the sheet interval adjustment process, based on a second conveyance distance from the standby position to the branching point.

4. The image forming apparatus according to claim 1, wherein, in a case where an end portion of the second sheet disposed on the upstream side in the second conveyance direction inside the circulation path is located at the branching point at the timing when the measurement of the elapsed time is started, the controller calculates the third time period in the sheet interval adjustment process, based on a distance acquired by subtracting a length of the sheet in the conveyance direction from a third conveyance distance for conveyance from the branching point to the branching point passing through the circulation path and the discharge path.

5. The image forming apparatus according to claim 1, wherein the circulation roller includes a first circulation roller that is disposed on the upstream side in the second conveyance direction in the circulation path, and conveys the sheet from the discharge and reversal path to the circulation path by rotating in linkage with the discharge and reverse roller, and wherein the controller calculates the delay time using T8=T5+T6−T7 in the sheet interval adjustment process, in a case where, a fifth time period T5 is defined as a time period required for conveying the second sheet that is in a state in which the end portion disposed on the upstream side in the second conveyance direction is located at the branching point up to a position at which the end portion disposed on the upstream side in the second conveyance direction passes through the first circulation roller, a sixth time period 16 is defined as a time period required for switching a rotation direction of the discharge and reverse roller, a seventh time period T7 is defined as a time period required for conveying the first sheet that is in a state in which the end portion disposed on the downstream side in the first conveyance direction is located at the branching point up to a position at which the end portion disposed on the downstream side in the first conveyance direction is brought into contact with the discharge and reverse roller, and a delay time 18 is defined as a time used for delaying timing for conveying the second sheet toward the image forming unit.

6. The image forming apparatus according to claim 1 further comprising:

a sheet sensor that detects whether or not the sheet is conveyed on the conveyance path, wherein the controller performs a sheet length detecting process in which the length of the sheet in the conveyance direction is detected based on a time until the sheet is not detected after detection of the sheet using the sheet sensor.

7. The image forming apparatus according to claim 6, wherein the controller performs a discharge process, in which the sheet is discharged from the discharge port, by stopping a process of reversing the sheet in accordance with the length of the sheet detected in the sheet length detecting process being larger than a maximum sheet length that can be reversed by the discharge and reverse roller.

8. An image forming apparatus comprising:

a conveyance path;

a supply device that supplies a sheet to the conveyance path;

an image forming unit that forms an image on the sheet conveyed through the conveyance path;

a discharge port;

a discharge and reverse roller that discharges or reverses the sheet, on which the image is formed by the image forming unit, from the discharge port;

a circulation roller that conveys the sheet reversed by the discharge and reverse roller; and a controller, wherein, in a case where a conveyance direction of the sheet conveyed from the image forming unit toward the discharge port is defined as a first conveyance direction, and a direction in which the sheet reversed by the discharge and reverse roller is conveyed toward the circulation roller is defined as a second conveyance direction, the conveyance path includes:

a branching point that is disposed on a further downstream side in the first conveyance direction than a position of the image forming unit;

a merging point that is disposed on a further upstream side in the first conveyance direction than the position of the image forming unit;

a discharge path that connects the supply device to the branching point through the image forming unit;

a discharge and reversal path that connects the branching point to the discharge port through the discharge and reverse roller; and a circulation path that connects the branching point to the merging point not through the image forming unit but through the circulation roller, and wherein the controller is configured to cause the image forming apparatus to perform:

a consecutive image forming process in which, in a case where an image is formed by the image forming unit on each face of two sheets including a first sheet and a second sheet, an image is formed on a first face of the second sheet during a period after an image is formed on a first face of the first sheet and until an image is formed on a second face of the first sheet by a reversal of the first sheet; and a sheet interval adjustment process in which in a case where, a reversal position is defined at a position at which an end portion of the sheet disposed on an upstream side in the first conveyance direction reaches when a sheet conveyed through the discharge and reversal path in the first conveyance direction is reversed by the discharge and reverse roller, a first time period is defined as a time period required for conveying the end portion of the sheet, which is conveyed in the first conveyance direction, disposed on the upstream side in the first conveyance direction up to the reversal position after an end portion of the sheet disposed on the downstream side in the first conveyance direction passes through the branching point, and a second time period is defined as a time period required for conveying an end portion of the reversed sheet disposed on an upstream side in the second conveyance direction from the reversal position to the branching point, a time difference between the first sheet having the image formed and reversed in the consecutive image forming process and the second sheet on which an image is formed after the first sheet is set to a time longer than a time acquired by adding the first time period and the second time period, wherein, in the sheet interval adjustment process, the controller is configured to cause the image forming apparatus to perform:

a first time period calculating process calculating the first time period using T1=(X1+L)/V1 in a case where the first time period is denoted by T1, a fourth conveyance distance between the branching point and the reversal position is denoted by X1, a speed at which the sheet is conveyed from the branching point to the reversal position in the first conveyance direction is a first conveyance speed V1, and a length of the sheet in the conveyance direction is denoted by L; and a second time period calculating process calculating the second time period using $T2=(X1+L)/V2$ in a case where the second time period is denoted by T2, and a speed at which the sheet is conveyed from the reversal position to the branching point in the second conveyance direction is a second conveyance speed V2.

9. The image forming apparatus according to claim 8, wherein the controller is configured to further perform:

an elapsed time measuring process in which an elapsed time after the end portion of the first sheet, which is conveyed in the first conveyance direction, disposed on the downstream side in the first conveyance direction passes through the branching point is measured; and in the sheet interval adjustment process, conveys the second sheet toward the image forming unit in response to timing satisfying $T4>(T1+T2-T3)$ in a case where the first time period is denoted by T1, the second time period is denoted by T2, a third time period T3 is defined as a time period required for conveying the second sheet from a position located at timing when the measurement of the elapsed time is started to the branching point, and an the elapsed time is denoted by T4.

10. The image forming apparatus according to claim 9, wherein, in a case where the second sheet is arranged at a supply position of the supply device at the timing when the measurement of the elapsed time is started, the controller calculates the third time period in the sheet interval adjustment process, based on a first conveyance distance from the supply position to the branching point.

11. The image forming apparatus according to claim 9, wherein, in a case where the second sheet is made to stand by at a standby position of the circulation path at the timing when the measurement of the elapsed time is started, the controller calculates the third time period in the sheet interval adjustment process, based on a second conveyance distance from the standby position to the branching point.

12. The image forming apparatus according to claim 9, wherein, in a case where an end portion of the second sheet disposed on the upstream side in the second conveyance direction inside the circulation path is located at the branching point at the timing when the measurement of the elapsed time is started, the controller calculates the third time period in the sheet interval adjustment process, based on a distance acquired by subtracting a length of the sheet in the conveyance direction from a third conveyance distance for conveyance from the branching point to the branching point passing through the circulation path and the discharge path.

13. The image forming apparatus according to claim 9, wherein the circulation roller includes a first circulation roller that is disposed on the upstream side in the second conveyance direction in the circulation path, and conveys the sheet from the discharge and reversal path to the circulation path by rotating in linkage with the discharge and reverse roller, and wherein the controller calculates the delay time using $T8=T5+T6-T7$ in the sheet interval adjustment process, in a case where, a fifth time period T5 is defined as a time period required for conveying the second sheet that is in a state in which the end portion disposed on the upstream side in the second conveyance direction is located at the branching point up to a position at which the end portion disposed on the upstream side in the second conveyance direction passes through the first circulation roller, a sixth time period T6 is defined as a time period required for switching a rotation direction of the discharge and reverse roller, a seventh time period T7 is defined as a time period required for conveying the first sheet that is in a state in which the end portion disposed on the downstream side in the first conveyance direction is located at the branching point up to a position at which the end portion disposed on the downstream side in the first conveyance direction is brought into contact with the discharge and reverse roller, and a delay time T8 is defined as a time used for delaying timing for conveying the second sheet toward the image forming unit.

14. The image forming apparatus according to claim 8 further comprising:

a first drive source that drives the discharge and reverse roller, wherein the controller controls the first drive source to perform a conveyance speed changing process in which the second conveyance speed is set to be higher than the first conveyance speed.

15. The image forming apparatus according to claim 8, wherein the circulation roller includes a first circulation roller that is disposed on the upstream side in the second conveyance direction in the circulation path and conveys the sheet at the second conveyance speed from the discharge and reversal path to the circulation path by rotating in linkage with the discharge and reverse roller and a second circulation roller that is disposed on a further downstream side in the second conveyance direction than a position of the first circulation roller and conveys the sheet at a third conveyance speed in the circulation path, and wherein the controller calculates the second time period using $T2=(X1+L)/V2$ in accordance with $X3\geq L$ and calculates the second time period using $T2=X2/V2+(L-X3)/V3$ in accordance with $X3<L$ in the second time period calculating process, in a case where the third conveyance speed is denoted by V3, a fifth conveyance distance between the reversal position and the second circulation roller is denoted by X2, and a sixth conveyance distance between the branching point and the second circulation roller is denoted by X3.

16. An image forming apparatus comprising:

a conveyance path;

a supply device that supplies a sheet to the conveyance path;

a sheet sensor that detects whether or not the sheet is conveyed on the conveyance path, an image forming unit that forms an image on the sheet conveyed through the conveyance path;

a discharge port;

a discharge and reverse roller that discharges or reverses the sheet, on which the image is formed by the image forming unit, from the discharge port;

a circulation roller that conveys the sheet reversed by the discharge and reverse roller; and a controller, wherein, in a case where a conveyance direction of the sheet conveyed from the image forming unit toward the discharge port is defined as a first conveyance direction, and a direction in which the sheet reversed by the discharge and reverse roller is conveyed toward the circulation roller is defined as a second conveyance direction, the conveyance path includes:

a branching point that is disposed on a further downstream side in the first conveyance direction than a position of the image forming unit;

a merging point that is disposed on a further upstream side in the first conveyance direction than the position of the image forming unit;

a discharge path that connects the supply device to the branching point through the image forming unit;

a discharge and reversal path that connects the branching point to the discharge port through the discharge and reverse roller; and a circulation path that connects the branching point to the merging point not through the image forming unit but through the circulation roller, and wherein the controller is configured to cause the image forming apparatus to perform:

a consecutive image forming process in which, in a case where an image is formed by the image forming unit on each face of two sheets including a first sheet and a second sheet, an image is formed on a first face of the second sheet during a period after an image is formed on a first face of the first sheet and until an image is formed on a second face of the first sheet by a reversal of the first sheet; and a sheet interval adjustment process in which in a case where, a reversal position is defined at a position at which an end portion of the sheet disposed on an upstream side in the first conveyance direction reaches when a sheet conveyed through the discharge and reversal path in the first conveyance direction is reversed by the discharge and reverse roller, a first time period is defined as a time period required for conveying the end portion of the sheet, which is conveyed in the first conveyance direction, disposed on the upstream side in the first conveyance direction up to the reversal position after an end portion of the sheet disposed on the downstream side in the first conveyance direction passes through the branching point, and a second time period is defined as a time period required for conveying an end portion of the reversed sheet disposed on an upstream side in the second conveyance direction from the reversal position to the branching point, a time difference between the first sheet having the image formed and reversed in the consecutive image forming process and the second sheet on which an image is formed after the first sheet is set to a time longer than a time acquired by adding the first time period and the second time period, a sheet length detecting process in which the length of the sheet in the conveyance direction is detected based on a time until the sheet is not detected after detection of the sheet using the sheet sensor.

17. The image forming apparatus according to claim 16, wherein, in the sheet interval adjustment process, the controller performs:

a first time period calculating process calculating the first time period using $T1=(X1+L)/V1$ in a case where the first time period is denoted by T1, a fourth conveyance distance between the branching point and the reversal position is denoted by X1, a speed at which the sheet is conveyed from the branching point to the reversal position in the first conveyance direction is a first conveyance speed V1, and a length of the sheet in the conveyance direction is denoted by L; and a second time period calculating process calculating the second time period using $T2=(X1+L)/V2$ in a case where the second time period is denoted by T2, and a speed at which the sheet is conveyed from the reversal position to the branching point in the second conveyance direction is a second conveyance speed V2.

18. The image forming apparatus according to claim 16 further comprising:

a first drive source that drives the discharge and reverse roller, wherein the controller controls the first drive source to perform a conveyance speed changing process in which the second conveyance speed is set to be higher than the first conveyance speed.

19. The image forming apparatus according to claim 16, wherein the circulation roller includes a first circulation roller that is disposed on the upstream side in the second conveyance direction in the circulation path and conveys the sheet at the second conveyance speed from the discharge and reversal path to the circulation path by rotating in linkage with the discharge and reverse roller and a second circulation roller that is disposed on a further downstream side in the second conveyance direction than a position of the first circulation roller and conveys the sheet at a third conveyance speed in the circulation path, and wherein the controller calculates the second time period using $T2=(X1+L)/V2$ in accordance with $X3 \geq L$ and calculates the second time period using $T2=X2/V2+(L-X3)/V3$ in accordance with $X3<L$ in the second time period calculating process, in a case where the third conveyance speed is denoted by V3, a fifth conveyance distance between the reversal position and the second circulation roller is denoted by X2, and a sixth conveyance distance between the branching point and the second circulation roller is denoted by X3.

20. The image forming apparatus according to claim 16, wherein the controller performs a discharge process, in which the sheet is discharged from the discharge port, by stopping a process of reversing the sheet in accordance with the length of the sheet detected in the sheet length detecting process being larger than a maximum sheet length that can be reversed by the discharge and reverse roller.

* * * * *